US007111335B2

(12) United States Patent
Noro et al.

(10) Patent No.: US 7,111,335 B2
(45) Date of Patent: Sep. 26, 2006

(54) BATHING AID

(75) Inventors: Masaru Noro, Moriguchi (JP); Masafumi Nishino, Moriguchi (JP); Tetsunari Hamada, Moriguchi (JP); Minoru Yonemoto, Ibaraki (JP); Toyoki Minamimoto, Ibaraki (JP)

(73) Assignees: Sanyo Electric Co., Ltd., Moriguchi (JP); Sanyo Electric Techno Clean Co., Ltd., Moriguchi (JP)

( * ) Notice: Subject to any disclaimer, the term of this patent is extended or adjusted under 35 U.S.C. 154(b) by 46 days.

(21) Appl. No.: 10/637,586

(22) Filed: Aug. 11, 2003

(65) Prior Publication Data

US 2004/0034917 A1 Feb. 26, 2004

(30) Foreign Application Priority Data

Aug. 26, 2002 (JP) ..... 2002-244653

(51) Int. Cl.
*A47K 3/02* (2006.01)

(52) U.S. Cl. ..... 4/556; 4/555; 4/578.1

(58) Field of Classification Search ..... 4/550, 4/554–556, 589, 590, 560.1–566.1, 571.1, 4/540, 573.1, 575.1, 578.1
See application file for complete search history.

(56) References Cited

U.S. PATENT DOCUMENTS 3,169,253 A * 2/1965 Segar ..... 4/611
3,662,409 A * 5/1972 Johansson ..... 4/560.1
4,432,104 A * 2/1984 Sasaki ..... 4/555
5,197,153 A * 3/1993 Hara ..... 4/451.4
5,393,119 A * 2/1995 Mukai ..... 297/217.1
5,722,099 A * 3/1998 Suzuki et al. ..... 4/555
6,766,543 B1 * 7/2004 Hollis et al. ..... 4/555

FOREIGN PATENT DOCUMENTS

JP B2 2628568 4/1997
JP A 2000-116745 4/2000
JP 2000167011 A * 6/2000

* cited by examiner

*Primary Examiner*—Huyen Le
(74) *Attorney, Agent, or Firm*—Oliff & Berridge, PLC

(57) ABSTRACT

A bathtub 12 is supported by a movable unit 14 that vertically moves by the driving power of a motor and by rollers 13 running on a guide slope 15. When not used, the bathtub 12 is stored under a tank 11 in a close to upright position, so that the bathing aid occupies only a small space when not used. To use the bathing aid, the movable unit 14 is lowered and, accordingly, the rollers 13 roll down the guide slope 15. With this motion, the bathtub 12 changes its orientation from a position where the open top of the bathtub 12 is directed obliquely forward to a position where the open top is directed almost upward. The bathtub 12 is automatically driven by the electrical driving power of the motor; the caregiver has only to make some key operations. Thus, the workload on the caregiver is significantly reduced.

9 Claims, 30 Drawing Sheets

SWa-: BATHTUB POSITION DETECTION SWITCH(ES) CORRESPONDING TO POSITION(S) MORE TILTED FROM VERTICAL AXIS THAN SWa

SWa+: BATHTUB POSITION DETECTION SWITCH(ES) CORRESPONDING TO POSITION(S) CLOSER TO UPRIGHT POSITION THAN SWa

NORMAL BATHING CONDITION

SETTING CONDITION (SITZ BATH)

BATHING AID

The present invention relates to a bathing aid for assisting the physically challenged, elderly or similar persons requiring nursing care for being bathed by a caregiver.

BACKGROUND OF THE INVENTION

Various types of bathing aids have been developed for those who have difficulty in standing up and/or bathing by themselves. Those people include the physically challenged, elderly and invalids, who are generally called "cared persons" hereinafter. Some bathing aids are constructed so that the cared person sitting on a wheelchair can be easily transferred from the wheelchair into a bathtub, into which hot water can be supplied.

An example of such bathing aids is disclosed in the Japanese Patent No. 2,628,568. The bathing aid includes a bathtub capable of rotating from a horizontal position where the open top of the bathtub is directed almost upward to a tilted position where its open top is obliquely directed. In the latter position, the front end of the bathtub is located close to the floor. In this position, the bathtub can be locked, allowing the cared person to be slid from the wheelchair into the bathtub, together with the seat unit. After receiving the cared person inside, the bathtub is unlocked, rotated to the horizontal position, and again locked in that position. Then, hot water is supplied into the bathtub to let the cared person bathe in a supine position.

The general situation of nursing care is such that caregivers have to do many jobs that require physical exertion, especially when they assist the cared person in taking a bath, as described above. Therefore, it has been desired to reduce the workload on the caregiver, especially when the work requires physical strength.

In the aforementioned conventional bathing aid, the seat unit of the wheelchair can be slid into the bathtub, as described above, so that the heavy work of manually lifting the cared person and setting her or him into the bathtub is eliminated, and the workload on the caregiver is reduced. For those who are weak in physical strength, however, it is not easy to rotate the bathtub with the cared person inside. Furthermore, it is necessary to transport the bathtub with the cared person into the bathroom to supply hot water into the bathtub. Therefore, to assist the cared person in bathing, the caregiver still has to use a considerable amount of time and labor.

In the bathing aid disclosed in the Japanese Unexamined Patent Publication No. 2000-116745, a commercial product of which is the "CHAIR IN BATH" manufactured by OG GIKEN CO., LTD., the bathtub has a door on one side of its body, and the wheelchair can be separated into the seat unit and the bogie unit. With the door of the bathtub open, when the wheelchair carrying the cared person is pushed close to the bathtub and brought into contact with the bathtub, the seat unit carrying the cared person slides into the bathtub, leaving the bogie unit below the bottom of the bathtub, i.e. in the outside of the bathtub. After that, the door is closed, and hot water is supplied into the bathtub to let the cared person bathe.

The above bathing aid is integrated with a water supply system, which to some extent reduces the workload on the caregiver. However, the above bathing aid is large-sized and requires a sizeable installation space because it is designed for use in nursing care facilities or similar facilities where the installation space can be easily located. Therefore, it is very difficult to install the above bathing aid in ordinary houses for home nursing care. Thus, people have been demanding for a small-size bathing aid that occupies only a limited space and can be used even in an ordinary house. The reduced size will be advantageous also for nursing care facilities because it allows them to use plural sets of bathing aids.

Cared persons who use the bathing aid may often have difficulty in moving by themselves, or sometimes in speaking by themselves. Therefore, with respect to safety, adequate measures are necessary to protect the cared person from dangerous situations during bathing. Conventional bathing aids, however, are designed on the assumption that caregivers would be there to watch the cared person at all times during bathing. Attention has not been adequately paid to the safety under the condition where the caregiver is not watching.

The inherent purposes of bathing aids are to keep the body of the cared person clean, to let the cared person feel relaxed and refreshed by bathing so that she or he can be in good mental condition, and sometimes to expect curative effects on the body from heating or other treatment. In respect of such inherent purposes, it is important to obtain better effects than conventionally obtained.

The present invention addresses the above problems, and the first objective of the invention is to provide a user-friendly bathing aid that reduces the workload on caregivers and can be easily operated even by those who are relatively small in body size and/or weak in physical strength.

The second objective of the present invention is to provide a bathing aid that requires only a small installation space.

The third objective of the present invention is to provide a bathing aid that offers high safety to the cared person, i.e. the bather.

The fourth objective of the present invention is to provide a bathing aid that enables the cared person to have a good feeling of satisfaction, and that provides high bathing effects.

SUMMARY OF THE INVENTION

To solve the above problem, the present invention provides, as the first invention, a bathing aid, which includes:

a wheelchair separable into a seat unit for a bather to sit down on and a bogie unit located under the seat unit;

a bathtub having an open top for receiving the seat unit with the bather sitting thereon;

a bathtub supporter for supporting the bathtub while allowing the bathtub to change its orientation so that the direction of the open top changes between an upward direction and a frontward direction;

an electrical driving power source; and a bathtub actuator for changing the orientation of the bathtub using the driving power of the driving power source, wherein the bathtub is held in an upright position where the open top is directed almost frontward when the bathtub is not used.

In the bathing aid according to the first invention, the bathtub actuator changes the orientation of the bathtub by using the driving power of the driving power source, such as a motor. When a bather sitting in the wheelchair is transferred into the bathtub while sitting on the seat unit, or transferred from the bathtub back to the bogie unit of the wheelchair, the bathtub is held in a position where the open top of the bathtub is directed obliquely frontward so that the bather can be smoothly transferred into or out of the bathtub by sliding the seat unit. During bathing, the open top of the bathtub is directed more upward so that the entire body of the bather can be submerged under the hot water stored in the bathtub. When, on the other hand, the bathing aid is not used, or when it is stored, the bathtub is moved to an upright position where the open top of the bathtub is directed almost frontward.

In general, bathtubs are shaped like a long, shallow container so that the body of the bather can be submerged under water during bathing. Because of this design, the bathtub occupies a considerably large space in the front-to-back direction when it is used. When not used, the bathtub is brought to the upright position. This positioning reduces the occupational size of the bathtub in the front-to-back direction, so that it requires only a small storage space and is less obstructive to those who are around it. Furthermore, the bathing aid according to the first invention uses an electrical driving power to move the bathtub into the storage position. Therefore, the caregiver as an operator has only to do an easy operation, such as the pressing of an operation key; it is not necessary for the caregiver to manually move the bathtub or do similar jobs that require strong muscle strength. Thus, the workload on the caregiver is significantly reduced.

To solve the above problem, the present invention provides, as the second invention, a bathing aid, which includes:

a wheelchair separable into a seat unit for a bather to sit down on and a bogie unit located under the seat unit;

a bathtub having an open top for receiving the seat unit with the bather sitting thereon;

a bathtub supporter for supporting the bathtub while allowing the bathtub to change its orientation so that the direction of the open top changes between an upward direction and a frontward direction; and a tank located in the upper part of the bathtub supporter for storing hot water to be supplied into the bathtub, wherein the bathtub is held in an upright position where the open top is directed almost frontward under the tank when the bathtub is not used.

The bathing aid according to the second invention has a tank for storing hot water to be supplied into the bathtub for bathing, which tank is located in the upper part of the bathtub supporter. This construction greatly reduces the installation space, compared to the construction where the tank is placed on the floor, on the side or at the back. Similar to the case of the first invention, the bathtub may be shaped like a long, shallow container so that the body of the bather can be submerged under water during bathing. When not used, the bathtub can be brought to an upright position, where it is entirely stored in the space under the tank, with only a slight, if any, projection from the front face of the tank. Thus, the bathing aid, including the tank, requires only a small storage space and is less obstructive to those who are around it.

The bathing aid according to the first or second invention may further include an operation panel located at a place behind the bathtub held in the upright position where the operation panel is partially hidden by the bathtub when the bathtub is not used and held in the upright position, wherein an operation key or operation keys that are operated when the bathtub is in the upright position are arranged in such a part of the operation panel that is not hidden by the bathtub.

By the above construction, the key operation can be performed without problem even though the operation panel is partially hidden by the bathtub when the bathtub is not used. When the bathing aid is used, the bathtub is tilted, so that the front face of the operation panel is exposed and the keys can be operated very easily. This construction is preferable to efficiently use the surface of the bathing aid and reduce the entire size of the bathing aid.

To solve the above problem, the present invention provides, as the third invention, a bathing aid, which includes:

a wheelchair separable into a seat unit for a bather to sit down on and a bogie unit located under the seat unit;

a bathtub having an open top for receiving the seat unit with the bather sitting thereon;

a bathtub supporter for supporting the bathtub while allowing the bathtub to change its orientation so that the direction of the open top changes between an upward direction and a frontward direction;

an electrical driving power source; and a bathtub actuator for changing the orientation of the bathtub using the driving power of the driving power source, wherein the bathtub is held in an oblique position where the open top is directed obliquely frontward when the bather is transferred into or out of the bathtub, and the position of the bathtub is changed to a predetermined orientation after the bather is transferred into the bathtub for bathing.

In the bathing aid according to the third invention, the bathtub actuator changes the orientation of the bathtub by using the driving power of the driving power source, such as a motor, as in the case of the first invention. When a bather sitting in the wheelchair is transferred into the bathtub while sitting on the seat unit, or transferred from the bathtub back to the bogie unit of the wheelchair, the bathtub is held in a position where the open top of the bathtub is directed obliquely frontward so that the bather can be smoothly transferred into or out of the bathtub by sliding the seat unit. During bathing, the open top of the bathtub is directed more upward, and the user can specify the tilt angle (or orientation) of the bathtub for bathing beforehand. In a preferable mode of the invention, the caregiver can select the tilt angle, taking into account the preference or health condition of the bather.

The bathing aid according to the third invention uses an electrical driving power to set the bathtub at a desired orientation for bathing. Therefore, the caregiver as an operator has only to do an easy operation, such as the pressing of an operation key; it is not necessary for the caregiver to manually move the bathtub or do similar jobs that require strong muscle strength. Thus, the workload on the caregiver is significantly reduced. With a bather lying inside, the bathtub is so heavy that manual tilting of the bathtub will require a considerable amount of muscle strength. Furthermore, an irregular motion of the bathtub may give the bather undesired mental and/or physical stress. By the bathing aid according to the third invention, on the other hand, the bathtub is smoothly moved to a predetermined angle by an electrical driving power. This allows the bather to feel safe and more relaxed during bathing.

In a mode of the third invention, the bathing aid further includes a stopper for mechanically stopping the tilting motion of the bathtub by bumping against a part of the bathtub or against a member that moves with the tilting motion of the bathtub.

In the process of controlling the orientation of the bathtub by means of the driving power source, the bathtub actuator and the bathtub supporter, the bathtub may fail to stop at a desired position because of some electrical trouble (such as the runaway of a microcomputer due to a noise) or mechanical trouble. Even in such a case, the stopper of the bathing aid assuredly stops the bathtub at a certain position by bumping against a part of the bathtub or a member that moves corresponding to the tilting motion of the bathtub. This mechanism assuredly prevents the bather in the bathtub from falling into a situation where the head of the bather is lowered to an abnormally low level and is in danger of being submerged under water stored in the bathtub. Thus, the above bathing aid provides a high level of safety while offering a comfortable bathing condition to the bather.

To solve the above problem, the present invention provides, as the fourth invention, a bathing aid, which includes:

a wheelchair separable into a seat unit for a bather to sit down on and a bogie unit located under the seat unit;

a bathtub having an open top for receiving the seat unit with the bather sitting thereon;

a bathtub supporter for supporting the bathtub while allowing the bathtub to change its orientation so that the direction of the open top changes between an upward direction and a frontward direction;

an electrical driving power source;

a bathtub actuator for changing the orientation of the bathtub using the driving power of the driving power source;

a water supplier for supplying hot water into the bathtub;

a drainage mechanism for draining the hot water from the bathtub;

an operation unit for allowing an operator to enter a command for starting an operation; and an operation controller, responsive to the command for starting the operation through the operation unit after the bather is set into the bathtub with the open top directed obliquely upward, by controlling the driving power source, the bathtub actuator, the water supplier and the drainage mechanism, for changing the orientation of the bathtub to a predetermined orientation, for supplying water into the bathtub with the water supplier, for retaining the water stored in the bathtub to provide the bather with a bathing condition for a predetermined period of time, for draining the water from the bathtub after the lapse of the predetermined period of time, and for moving the bathtub back to the same orientation where the bather is transferred into the bathtub, in order to allow the bather to be transferred out of the bathtub.

With the bathing aid according to the fourth invention, the caregiver has only to transfer the bather sitting on the seat unit of the wheelchair into the bathtub, and to transfer the bather from the bathtub back to the bogie unit of the wheelchair after the bathing. The other functions necessary for bathing are automatically performed by the driving power source, the bathtub actuator, the water supplier, the drainage mechanism and other elements, all controlled by the operation controller. Examples of the functions include the supplying of water into the bathtub, the adjustment of the orientation of the bathtub for allowing the body of the bather to be appropriately submerged under water, the measurement of the desired bathing time, and the drainage of hot water from the bathtub. Therefore, the caregiver is not always required to be near the bathing aid and do the functions relating to the bathing; it may be allowed to do other kinds of jobs under some circumstances. Thus, the bathing aid according to the fourth invention greatly reduces the workload required for bathing a cared person.

To solve the above problem, the present invention provides, as the fifth invention, a bathing aid having:

a wheelchair separable into a seat unit for a bather to sit down on and a bogie unit located under the seat unit;

a bathtub having an open top for receiving the seat unit with the bather sitting thereon; and a tank for storing hot water to be supplied into the bathtub, which further includes:

a temperature-setting means for setting an objective temperature;

a temperature detector for detecting the temperature of the water stored in the tank; and a temperature regulator for detecting the temperature of the water stored in the tank with the temperature detector, and for regulating the temperature of the water within a vicinity of the objective temperature when the objective temperature is set by the temperature-setting means.

In the bathing aid according to the fifth invention, the hot water to be supplied into the bathtub is not directly taken from, for example, a hot-water supply pipe extending from a hot-water supply system, but from the tank in which hot water is stored beforehand. In the case of supplying hot water through a hot-water supply pipe, the water supply speed is restricted by the capacity of the hot-water supply system. Storing hot water in the tank beforehand by an amount greater than the capacity of the bathtub makes it possible to supply the necessary amount of hot water into the bathtub in a shorter time than supplying hot water through the hot-water supply pipe. In the case where the bather is transferred into the bathtub before the hot water is supplied into the bathtub, the present method preferably shortens the time for which the bather has to wait in the bathtub. Since the temperature regulator regulates the hot water in the tank at a preset temperature, it is possible to supply hot water whose temperature is appropriately regulated according to the bather, the season, etc.

In a mode of the fifth invention, the bathing aid further includes a drainage mechanism for draining the hot water from the tank and a temperature pre-regulator for regulating the temperature of the hot water to be introduced into the tank at a temperature higher than the objective temperature, wherein the temperature regulator uses the drainage mechanism to drain the hot water by an amount determined according to the difference between the temperature detected by the temperature detector and the objective temperature, and supplies the tank with additional hot water whose temperature is regulated by the temperature pre-regulator to make up for the decrease of the hot water in the tank.

By the above construction makes it possible to quickly heat the hot water in the tank to the objective temperature when the hot water is cooling down, while suppressing the discharging amount of the hot water, even if the tank itself has no heating means. Thus, it is possible to provide the bather with a comfortable bathing condition by supplying hot water at a temperature almost equal to the objective temperature from the tank into the bathtub almost at all times.

The bathing aid according to the fifth invention may preferably include a bubble generator for supplying bubbles into the tank.

Since the tank has a large capacity, the hot water stored therein is likely to have different temperatures at different locations. By supplying bubbles into the hot water in the tank, the bubble generator equalizes the temperature of the hot water, so that the temperature detector can accurately detect the temperature. This makes it easier to maintain the hot water in the tank at a desired temperature, so that hot water having an undesired temperature is prevented from being supplied into the bathtub. Thus, it is possible to provide the bather with a comfortable bathing condition.

The bathing aid according to the fifth invention may further include:

a temperature indicator for indicating the numerical value of the objective temperature;

an input device for changing the numerical value indicated by the temperature indicator; and a confirmation means for fixing the numerical value indicated by the temperature indicator as the objective temperature.

The objective temperature set by the temperature-setting means is a very important parameter for bathing. Temperatures that are too low or too high can negatively affect the health condition of the bather, and might be fatal in the worst-case scenario. The above bathing aid does not allow the temperature setting to be effective until the numerical value of the temperature determined through the input device is confirmed through the confirmation means. This method prevents such mistakes that the temperature setting is changed by some operations not intended by the caregiver (i.e. operator) or the temperature setting is changed without adequately being checked. With this high level of safety, the bather can feel safe in bathing, and the caregiver does not need to be unnecessarily concerned with regards to the operation.

To solve the above problem, the present invention provides, as the sixth invention, a bathing aid having:

a wheelchair separable into a seat unit for a bather to sit down on and a bogie unit located under the seat unit, and bathtub having an open top for receiving the seat unit with the bather sitting thereon, wherein the seat unit of the wheelchair with the bather sitting thereon can be transferred into the bathtub before hot water is supplied into the bathtub, and a seat and a back of the seat unit have perforations.

In the bathing aid according to the sixth invention, when a bather is transferred into the bathtub and hot water is supplied into the bathtub, the hot water passes through the perforations and directly touches the back and buttocks of the bather. This removes the sweat and dirt on the body surface of the bather and makes the body of the bather cleaner. Without the feeling of hot water touching a part of the body, the bather would accordingly feel less relaxed or refreshed during bathing. The bathing aid according to the sixth invention provides the feeling of hot water touching all over the body, while supporting the body in a stable position. Thus, the bather can feel adequately satisfied. To promote the contact between the hot water and the body of the bather, it is preferable to use a mesh material having a number of perforations for passing water.

To solve the above problem, the present invention provides, as the seventh invention, a bathing aid, which includes:

a wheelchair separable into a seat unit for a bather to sit down on and a bogie unit located under the seat unit, and a main unit including a bathtub having an open top for receiving the seat unit with the bather sitting thereon, whereby the seat unit of the wheelchair with the bather sitting thereon is transferred into the bathtub, and then hot water is supplied into the bathtub, wherein the seat unit of the wheelchair has plural water level marks on a back thereof; and the main unit includes:

an input device for setting a value corresponding to an amount of hot water, using the level marks as a reference; and a water supplier for supplying hot water into the bathtub based on the value set through the input device.

In bathing aids, to what depth the hot water should be stored in the bathtub for bathing (i.e. to what location on the body of the bather the hot water should be stored) must be determined with respect to not only the preference of the bather but also the health conditions of the bather and other factors. The body size, which differs from bather to bather, must be also considered. The bathing aid according to the seventh invention has plural level marks on the back of the seat unit of the wheelchair. Referencing the level marks, the caregiver can determine the amount of hot water by letting the cared person sit down in the seat unit, selecting the level mark that corresponds to the most appropriate water level, and setting the amount of hot water through the input device based on the level mark selected. Thus, the caregiver can definitely determine the amount of hot water. The determined amount rarely becomes too much or too little, so that the workload on the caregiver is reduced. Also, with an appropriate amount of hot water, the bather can feel safe in bathing.

To solve the above problem, the present invention provides, as the eighth invention, a bathing aid, which includes:

a wheelchair separable into a seat unit for a bather to sit down on and a bogie unit located under the seat unit;

a bathtub having an open top for receiving the seat unit with the bather sitting thereon;

a bathtub supporter for supporting the bathtub while allowing the bathtub to change its orientation so that the direction of the open top changes between an upward direction and a frontward direction;

an electrical driving power source;

a bathtub actuator for changing the orientation of the bathtub using the driving power of the driving power source;

a water supplier for supplying hot water into the bathtub;

an angle-setting means for specifying the orientation of the bathtub for a bathing time;

a water-amount-setting means for specifying the amount of hot water to be stored in the bathtub for bathing, with respect to the location on the body of the bather; and a water supply controller for determining a water level based on the amount of hot water specified by the water-amount-setting means and the orientation of the bathtub specified by the angle-setting means, and controlling the water supplier to supply hot water to the determined water level.

The water-amount-setting means may be constructed to determine the amount of hot water by using the plural level marks on the back of the seat unit employed in the bathing aid according to the seventh invention. In the bathing aid according to the eighth invention, the water level in the bathtub changes according to the orientation (or angle) of the bathtub during bathing even when the amount of hot water determined by the water-amount-setting means is the same. The water supply controller determines (or corrects) the water level by taking into account the orientation of the bathtub, and supplies hot water into the bathtub up to the determined water level. The caregiver has only to set the amount of hot water without considering the orientation of the bathtub. Thus, it is possible to supply an appropriate amount of hot water into the bathtub while reducing the workload on the caregiver, and to provide the bather with a comfortable and safe bathing condition.

BRIEF DESCRIPTION OF THE DRAWINGS

FIG. 5A is the front view and FIG. 5B is the side view

FIG. 22A is a general side view of the main unit, FIG. 22B is a front view without the bathtub, and FIG. 22C is an enlarged view of a part of FIG. 22B.

FIG. 23A is a side view and FIG. 23B is a front view.

DETAILED DESCRIPTION OF A PREFERRED EMBODIMENT

Referring to the attached drawings, an embodiment of the bathing aid according to the present invention is described. The bathing aid in this embodiment may be referred to as the "apparatus" or the "present apparatus" hereinafter.

Figure 1:
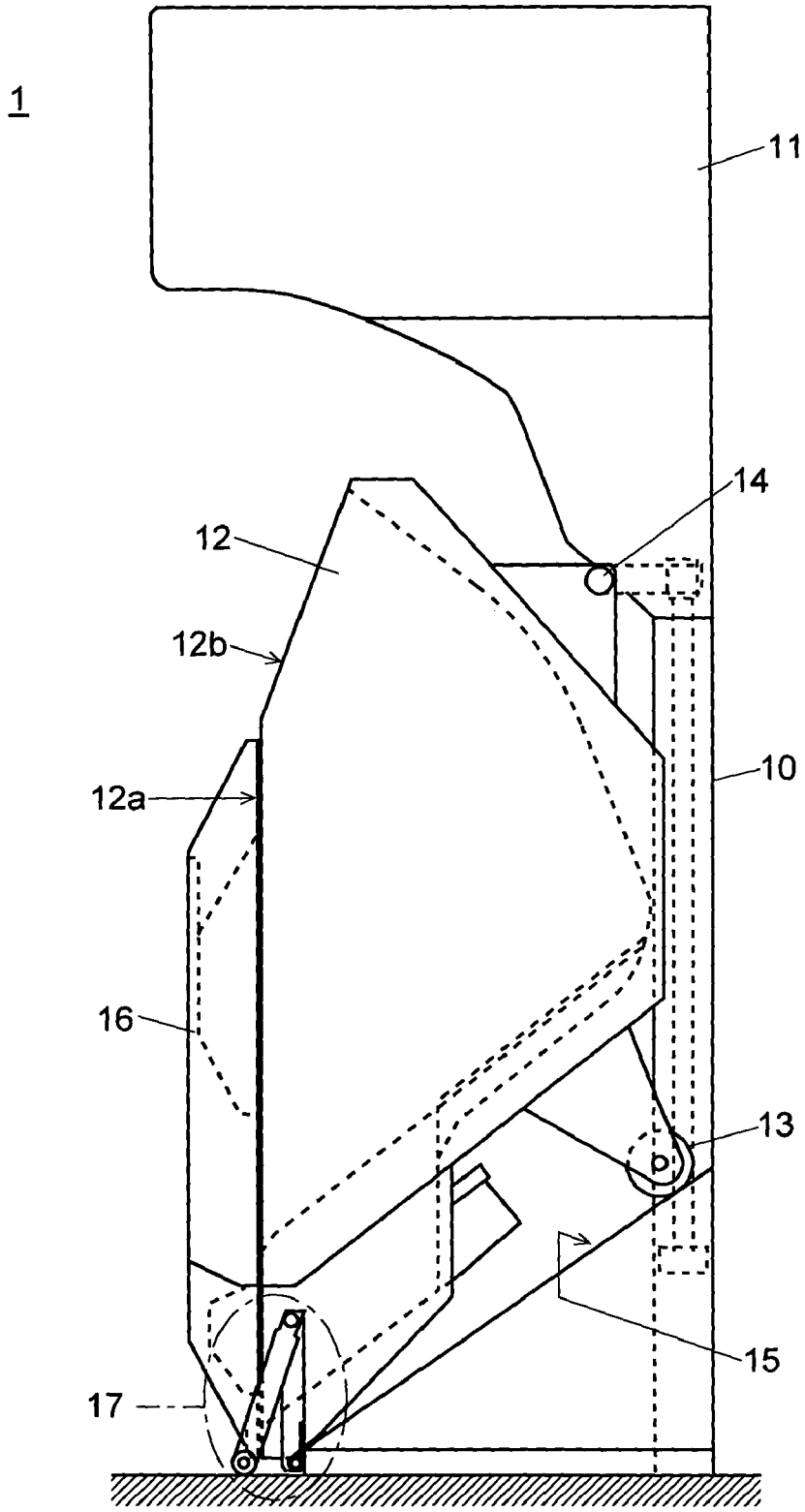
FIG. 1 is a side view schematically showing the general structure of the bathing aid of an embodiment of the present invention ("storage state").
Figure 2:
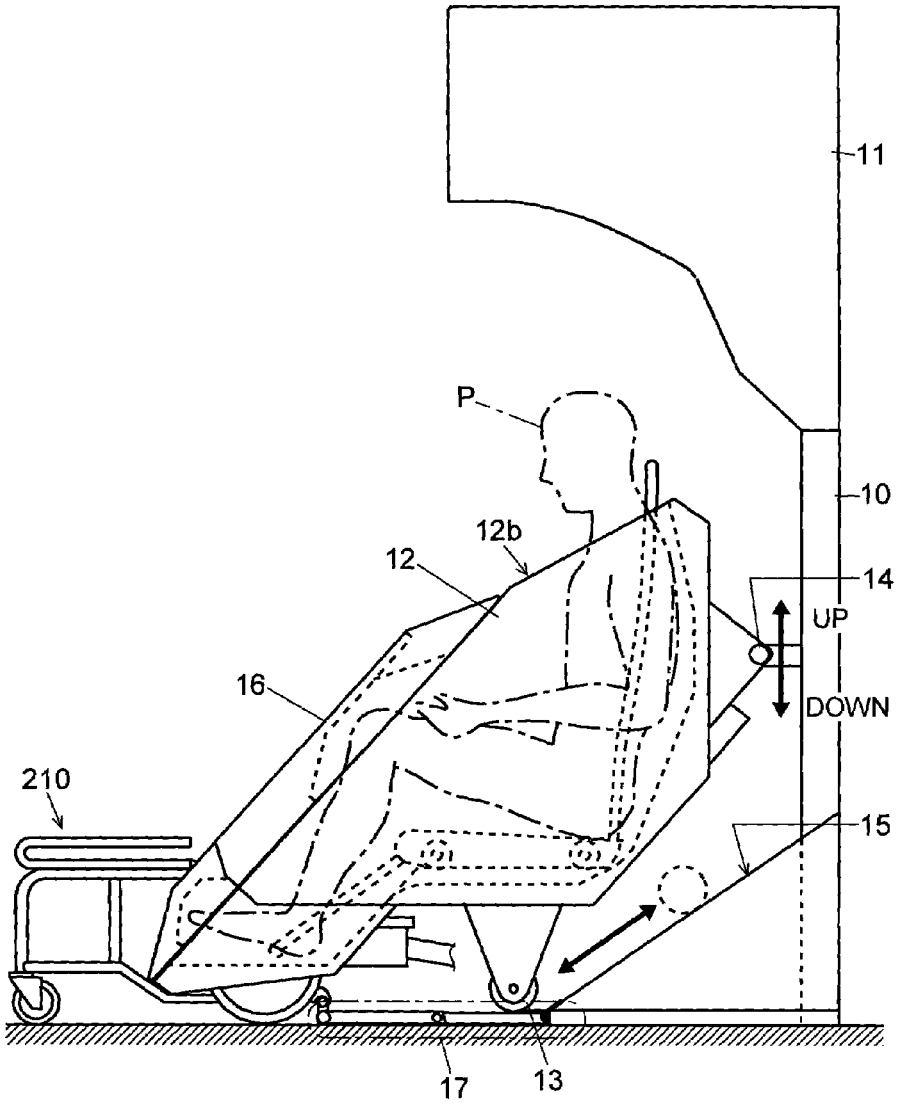
FIG. 2 is a side view schematically showing the general structure of the bathing aid of the embodiment ("setting state").
Figure 3:
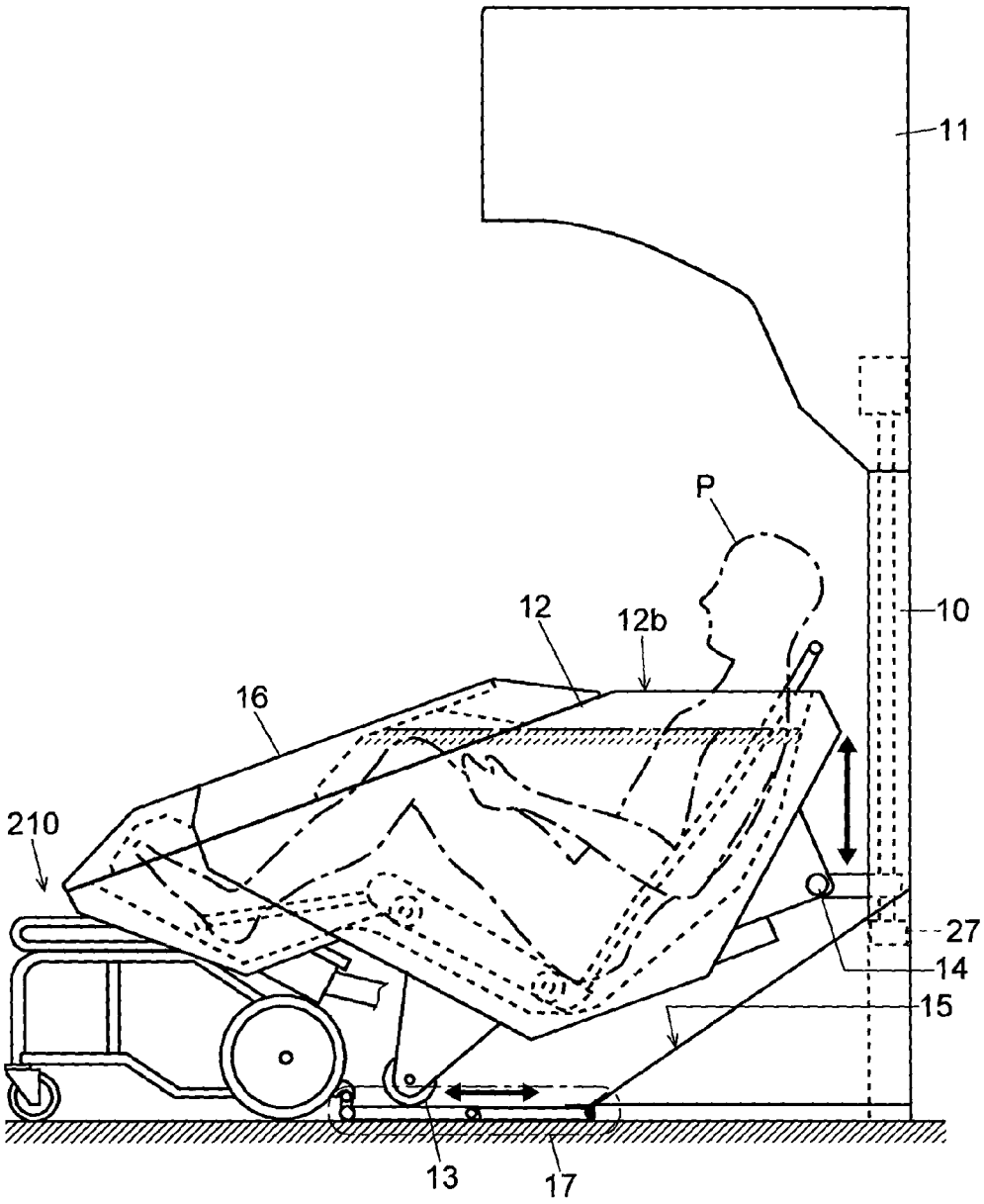
FIG. 3 is a side view schematically showing the general structure of the bathing aid of the embodiment ("normal bathing state").
Figure 4:
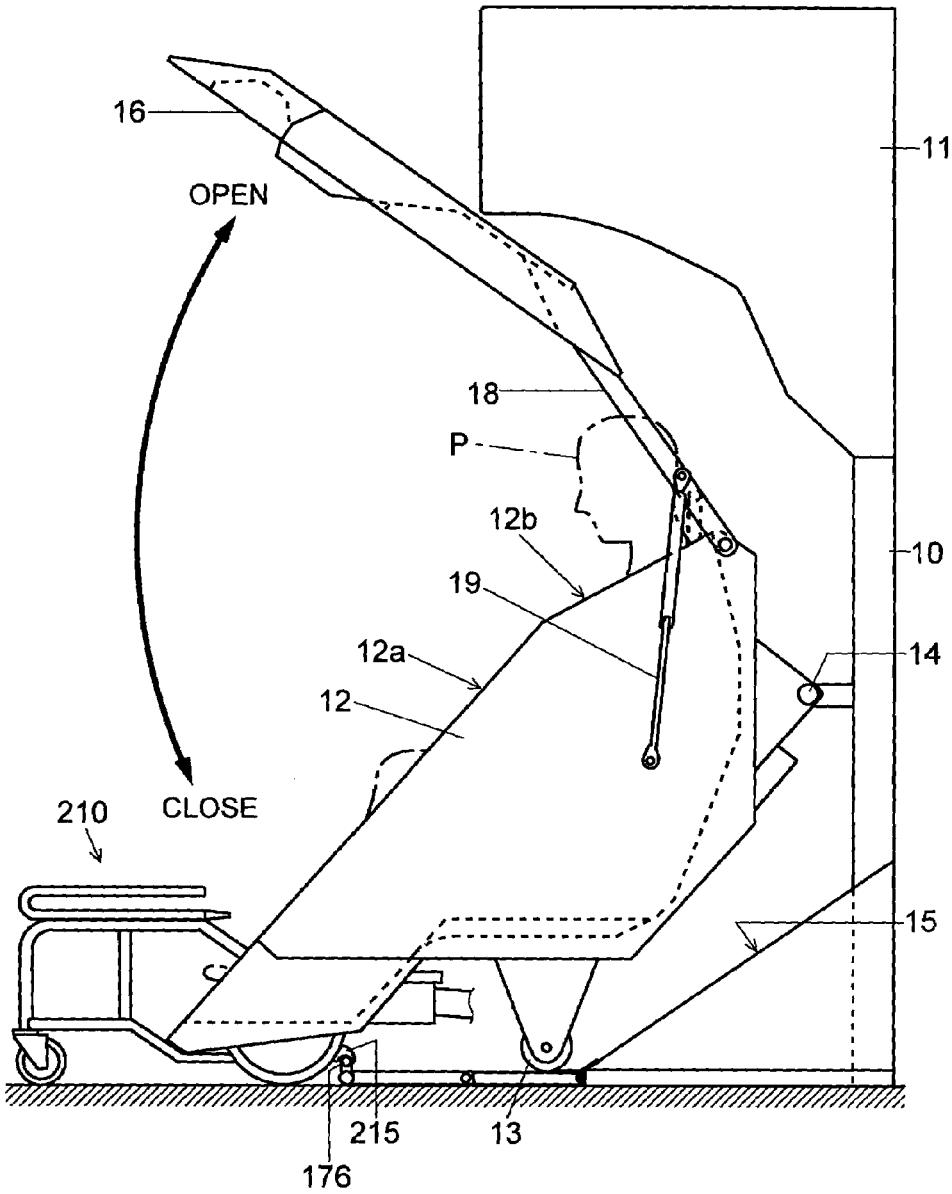
FIG. 4 is a side view of the bathing aid shown in FIG. 2 with the cover of the bathtub opened.
Figure 5B:
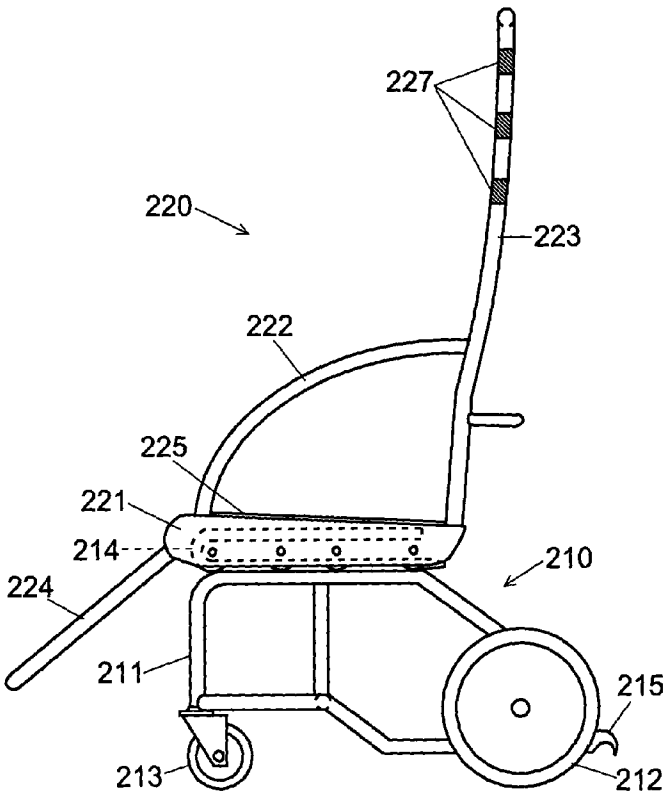
FIGS. 5A and 5B show the wheelchair to be exclusively used in the bathing aid of the embodiment, where
Figure 5A:
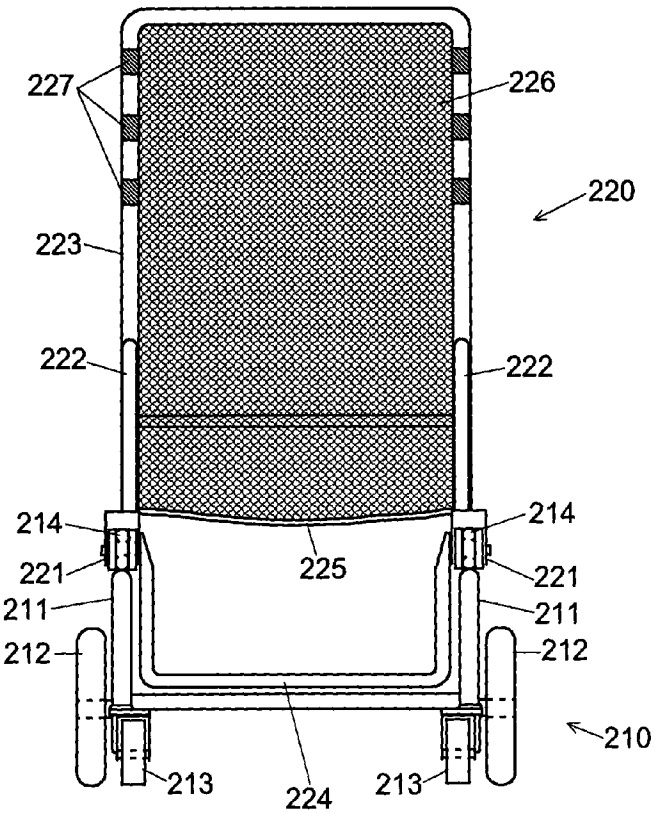

FIGS. 1–4 are side views schematically showing the general structure of the present apparatus. FIG. 1 shows the state where the bathtub is stored. FIG. 2 shows the state where the bather sitting in a wheelchair is transferred into the bathtub or transferred from the bathtub back to the wheelchair (this state is referred to as the "setting state" hereinafter). FIG. 3 shows the state where the bathtub is further tilted from the setting state to a state for bathing (this state is referred to as the "normal bathing state" hereinafter). FIG. 4 shows the state where the cover of the bathtub in FIG. 2 is opened. FIGS. 5A and 5B show the wheelchair to be exclusively used in the apparatus, where FIG. 5A is the front view and FIG. 5B is the side view.

The present apparatus is mainly composed of a main unit 1 with a bathtub 12 into which the bather (i.e. a cared person) in a sitting position is transferred, and a dedicated wheelchair 2 for transferring the bather into or out of the bathtub 12.

The main unit 1 has a pillar 10 located in the rear part and a tank 11 having the capacity of about 200L mounted on the pillar 10. The height of the top of the tank 11, i.e. the height of the present apparatus, is lower than the heights of the ceilings of ordinary houses. In Japan, for example, the height of the ceilings of most houses is about 2400 mm, so that the height of the present apparatus is set at about 2300 mm. This design allows the apparatus to be used for home nursing care. A shallow bathtub 12 having a front wall and a rear wall, both being sloped down toward the center of the bottom, is located under the tank 11. The bathtub 12 is supported by right and left bathtub rollers 13 located closer to the front than the lowest point of the bottom, and a supportive shaft 14 sticking out from the rear wall. The supportive shaft 14 is moved up and down by the action of a motor, pulling up or pushing down the rear end of the bathtub 12. A guide slope 15 tilted upward toward the back is located beneath the pillar 10. With the vertical motion of the supportive shaft 14 pulling up or pushing down the rear end of the bathtub 12, the bathtub rollers 13 go up and down along the guide slope 15.

The bathtub 12 has an open top 12*a* on one side that is directed upward in the normal bathing state, as shown in FIG. 3. The open top 12*a* can be closed with a cover 16 except for an opening 12*b* in the rear part, through which the bather can stick the their head through. As shown in FIG. 4, the cover 16 is fixed to the arms 18, each arm having one end hinged via a shaft to the rear end of each sidewall of the bathtub 12. Each arm 18 is modestly urged upward by a gas spring 19. When the cover 16 is pressed onto the open top 12*a* of the bathtub 12 as shown in FIG. 2, a lock mechanism (not shown) maintains the cover 16 locked. When the user manually unlocks the cover 16 and slightly pushes it up, the cover 16 slowly opens due to the action of the gas springs 19, and finally reaches the fully opened position, as shown in FIG. 4. In the state of FIG. 4, the open top 12*a* of the bathtub 12 is tilted frontward, and the bather P can be transferred into or out of the bathtub 12, as described later.

Figure 6:
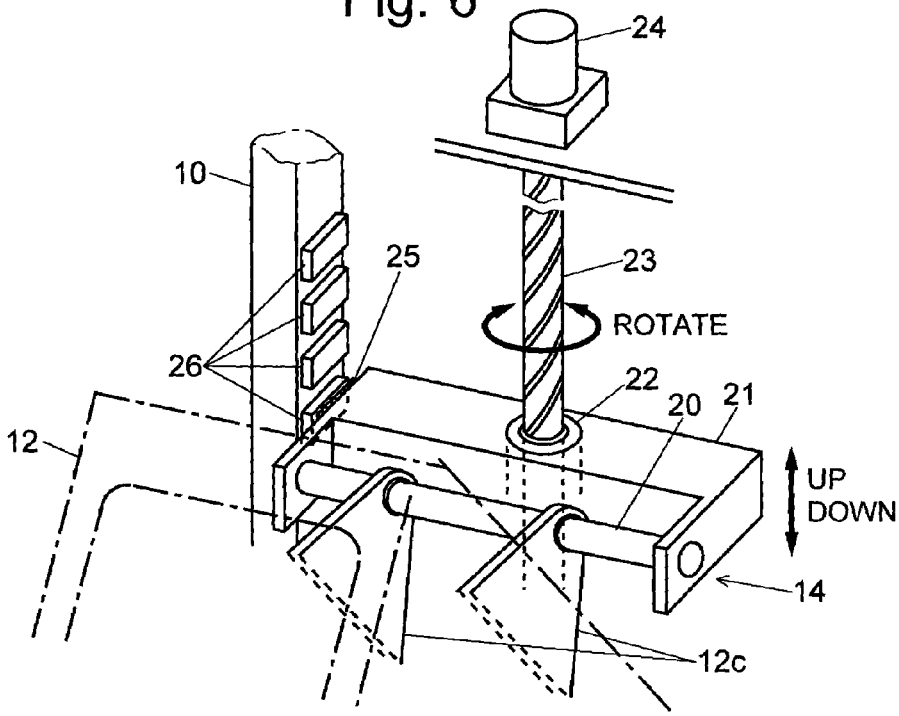
FIG. 6 is a perspective view of a part of the bathing aid of the embodiment including the supportive shaft for tilting the bathtub.
Figure 7:
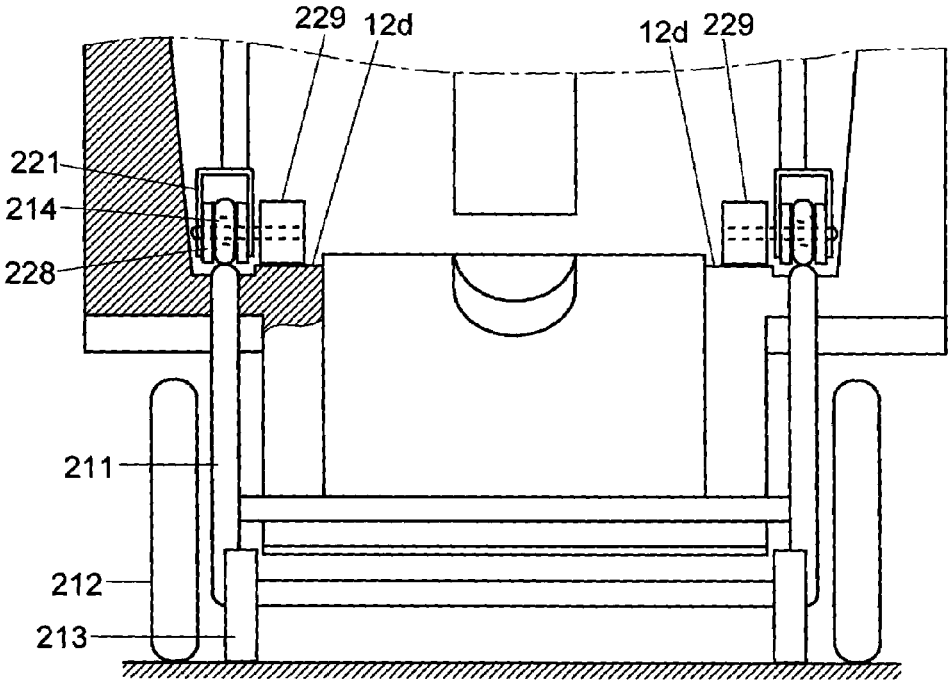
FIG. 7 is a front view of a part of the bathing aid of the present embodiment in the setting state.

FIG. 6 is a perspective view of the main part of the supportive shaft 14 for tilting the bathtub 12 of the main unit 1. The bathtub 12 has a pair of supporting plates 12*c* sticking out from the rear side. Each plate 12*c* has a hole, through which a horizontal shaft 20 is passed. Both ends of the shaft 20 are fixed to a movable unit 21, which has a ball screw nut 22 engaged with the grooves formed on the vertical screw shaft 23. When the screw shaft 23 is rotated by the motor 24, the balls in the ball screw nut 22 spirally roll along the grooves on the screw shaft 23. This makes the movable unit 21 move up or down along the screw shaft 23. This motion is transmitted via the horizontal shaft 20 and the plates 12*c* to the rear end of the bathtub 12. Thus, the rear end of the bathtub 12 is pulled up or pushed down.

In FIG. 6, a magnet 25 is attached to one side of the movable unit 21, and four reed switches 26 are vertically attached to the pillar 10 located close to the magnet 25. When the movable unit 21 moves up and down, the reed switches 26 turn on according to the position of the movable unit 21. This mechanism will be detailed later.

As shown in FIG. 5, the wheelchair 2 includes a bogie unit 210 having a front wheel 213 with a small diameter and a rear wheels 212 with a large diameter on each side, and a seat unit 220 for a bather to sit down on. The seat unit 220 can slide backward on the bogie unit 210. The seat unit 220 includes right and left bases 221 each having plural wheels inside, a back frame 223 fixed to the rear ends of the bases 221, and armrests 222 bridged between the back frame 223 and the bases 221. The bases 221 have a footrest 224 for the bather to rest the feet on. A mesh seat 225 is stretched between the two bases 221 with an appropriate tension, and a mesh backing 226 is similarly stretched on the back frame 223. The use of the mesh material for the seat 225 and the backing 226 allows water and air to freely pass through. Thus, the water and air can easily touch the parts of the body surface of the bather that are in contact with the seat 225 and the backing 226. The back frame 223 has three level marks to be used as a reference for the caregiver to determine the amount of hot water to supply.

Referring to FIGS. 7–11B in addition to FIG. 5, the mechanism for sliding the seat unit 220 of the wheelchair 2 and the steps of transferring the bather into or out of the bathtub 12 are described.

On the top of each of the right and left supporting bars 211 of the bogie unit 210, a U-shaped guide rail 214 is fixed with its open end directed backward. In the base 221 of the seat unit 220, four bogie-side rollers 228 are arranged in the back-to-front direction at appropriate intervals. Each roller 228 consists of a pair of disks 228*a* with a core 228*b* clamped in between. The disks 228*a* clamp the guide rail 214 from both sides, and the core 228*b* comes in contact with the guide rail 214 on its upper and lower sides. In addition, there are bathtub-side rollers 229 located on the inside of three of the four bogie-side rollers 228. The bogie-side rollers 228 rolling back and forth on the guide rails 214 enable the seat unit 220 to slide back and forth on the bogie unit 210, where the bathtub-side rollers 229 are not working. The bathtub 12 has bathtub-side rails 12*d* formed on its inner sidewalls. In the setting state, the bathtub-side rails 12*d* come to an almost horizontal position. When the seat unit 220 is in the bathtub 12, the bathtub-side rollers 229 roll on the bathtub-side rails 12*d*, producing the sliding motion of the seat unit 220. Inside the bathtub 12, the bogie-side rollers 228 do not work because they are in the air.

Figure 8:
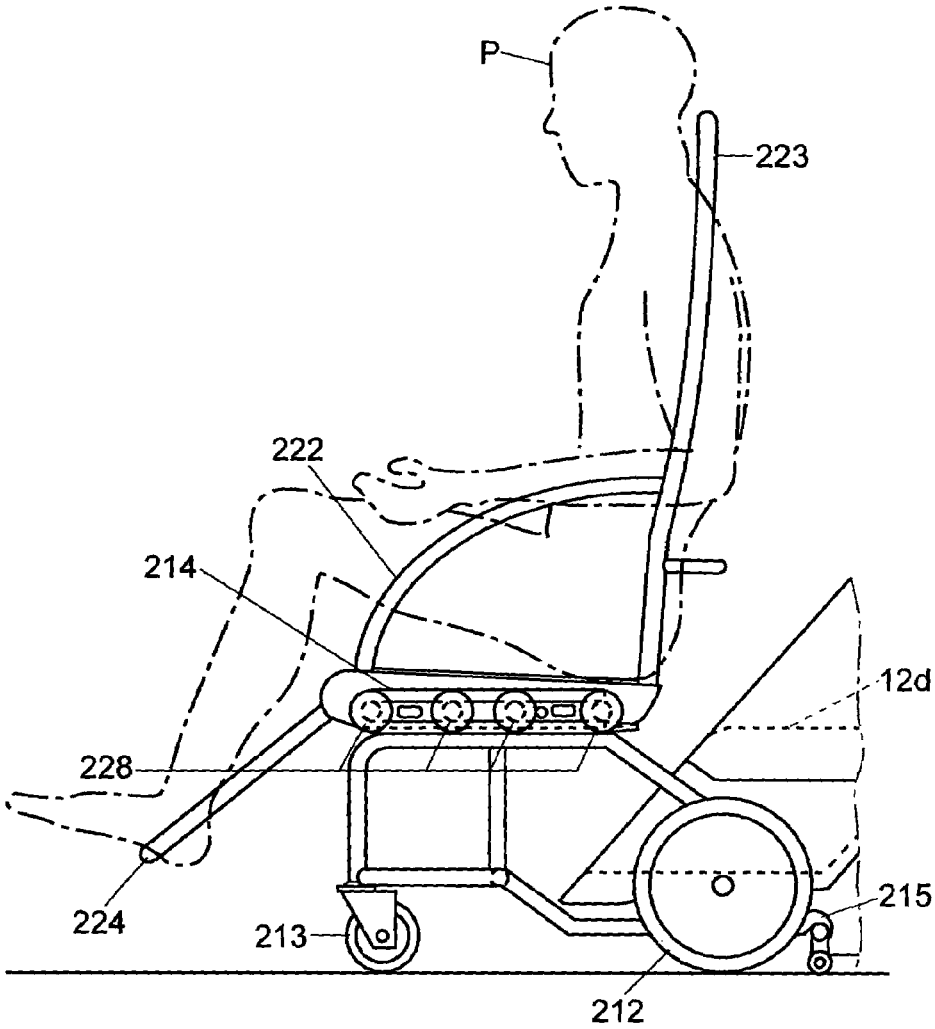
FIG. 8 is a side view of a part of the bathing aid of the present embodiment in the setting state.
Figure 9A:
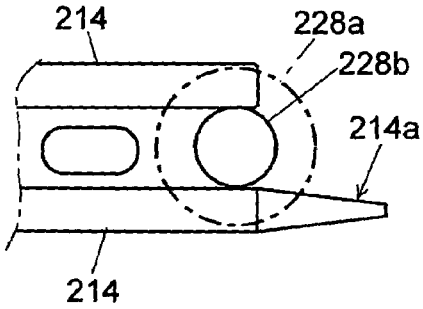
FIGS. 9A and 9B is an enlarged view of a part of the wheelchair shown in FIG. 5.
Figure 9B:
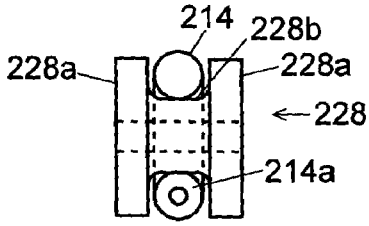

When the cover 16 is opened as shown in FIG. 4, the bather P sitting in the seat unit 220 of the wheelchair 2, as in FIG. 8, can be transferred into the bathtub 12 by the following steps.

As shown in FIG. 8, the wheelchair 2 is moved back toward the bathtub 12. Then, the bogie unit 210 is temporarily fastened to the main unit 1 by engaging the bogie-side hooks 215, located at the rear end of the bogie unit 210 of the wheelchair 2, with the stopper 176 of the main unit 1. From this state, the caregiver pushes the seat unit 220, or the bather P, into the bathtub 12. Then, the bogie-side rollers 228 roll on the guide rails 214, making the seat unit 220 sliding backward with the bather P sitting thereon.

Figure 10A:
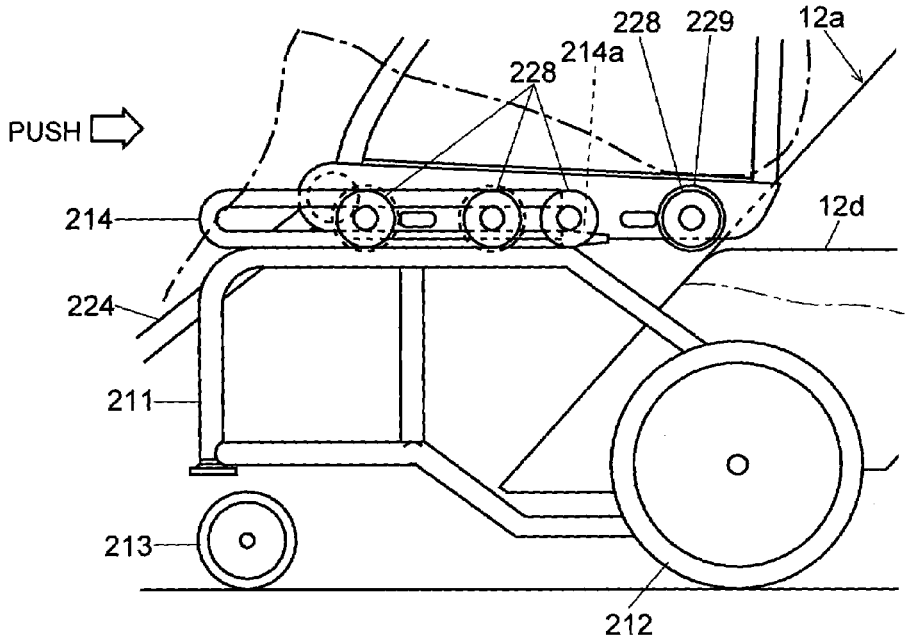
FIGS. 10A and 10B are side views of the wheelchair with a bather being transferred into the bathtub.
Figure 10B:
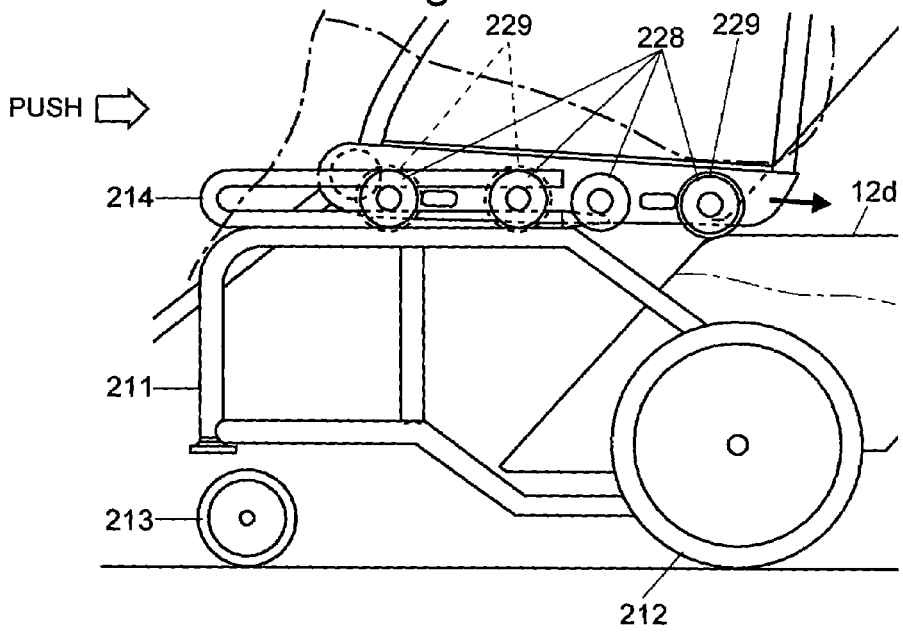

In the course of the sliding motion, even when, as shown in FIG. 10A, the rearmost bogie-side roller 228 comes off the guide rail 214, the seat unit 220 maintains itself almost horizontal because the other three bogie-side rollers 228 are still on the guide rail 214. Before the second rearmost bogie-side roller 228 comes off the guide rail 214, the rearmost bathtub-side roller 229 comes onto the bathtub-side rail 12*d*, as shown in FIG. 10B. After that, while the seat unit 220 is further pushed backward, the rear and front sides of the seat unit 220 is supported by the bathtub-side roller 229 and the bogie-side roller 228, respectively (see FIG. 11A).

Figure 11A:
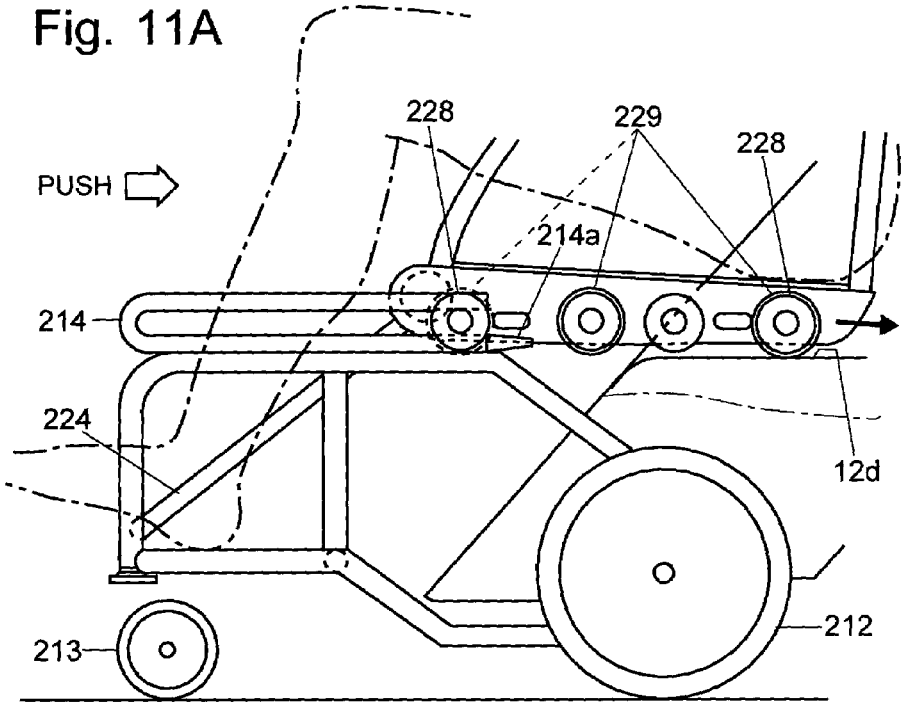
FIGS. 11A and 11B are side views of a bather being transferred from the wheelchair into the bathtub.
Figure 11B:
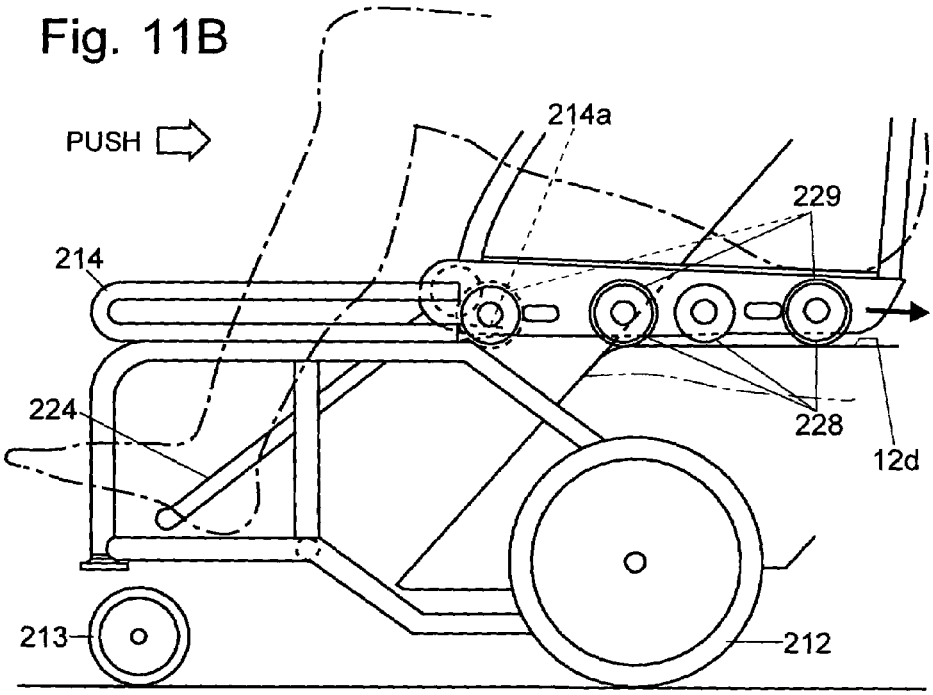

As shown in FIG. 11B, the second-from-the-front bathtub-side roller 229 comes onto the bathtub-side rail 12*d* before the foremost bogie-side roller 228 comes off the guide rail 214. After that, the bathtub-side rollers 229 roll on the bathtub-side rail 12*d*, making the seat unit 220 slide backward until the bather P is completely set in the bathtub 12. When the seat unit 220 is completely transferred into the bathtub 12, only the bogie unit 210 is left in front of the bathtub 12.

After bathing is completed, the seat unit 220 can be transferred from the bathtub 12 back to the bogie unit 210 of the wheelchair 2 by following the aforementioned steps in reverse.

Figure 12A:
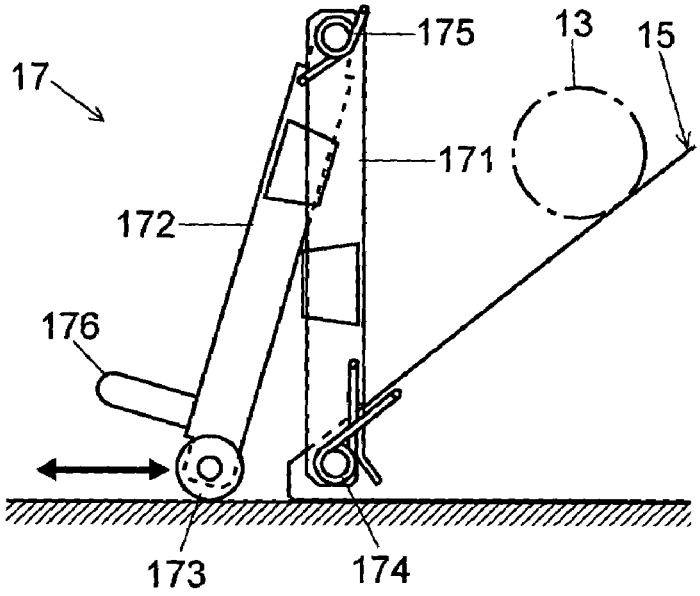
FIGS. 12A and 12B are side views of the expansion mechanism of the bathing aid of the embodiment.
Figure 12B:
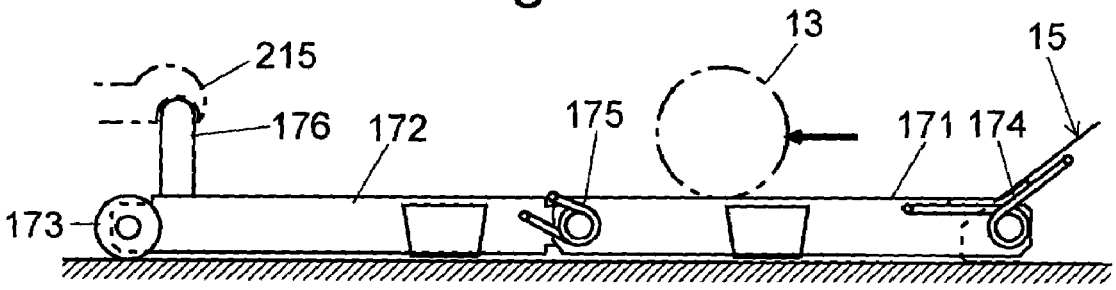

As described earlier, the main unit 1 is provided with the stopper 176 for fastening the bogie unit 210 of the wheelchair 2. When the bathtub 12 is stored as shown in FIG. 1, the stopper will be obstructive and may cause someone to stumble if it is left sticking frontward. Therefore, the present apparatus is provided with an expansion mechanism 17 for moving the stopper 176 back and forth along with the tilting motion of the bathtub 12. FIGS. 12A and 12B are side views showing the construction of the expansion mechanism 17. On each side of the guide slope 15, an end of the first member 171 is connected to the shaft. The first member 171 has a shaft at the other end, and an end of the second member 172 is connected to the shaft. The second member 172 has a roller 173 at the other end. The roller 173 is placed on the floor and rolls on it.

The connection part between the guide slope 15 and the first member 171 has a torsion coil spring 174, and the connection part between the first member 171 and the second member 172 has another torsion coil spring 175.

When no external force is exerted, the urging force of the torsion coil springs 174 and 175 makes the first member 171 and the second member 172 stand up with the roller 173 attracted to the guide slope 15 (see FIG. 12A). With the two members thus folded, the stopper 176 will never be obstructive. When the bathtub 12 is moved from the stored state to the setting state, the bathtub roller 13 comes down the guide slope 15, as described above. With the weight of the bathtub 12 exerted thereon, the bathtub roller 13 pushes down the first member 171, which in turn pushes down the second member 172 with the roller 173 rolling frontward. Thus, the two members 171 and 172 expand themselves, and finally become flattened on the floor with the stopper 176 standing upright at the front end of the second member 172, as shown in FIG. 12B.

Figure 13A:
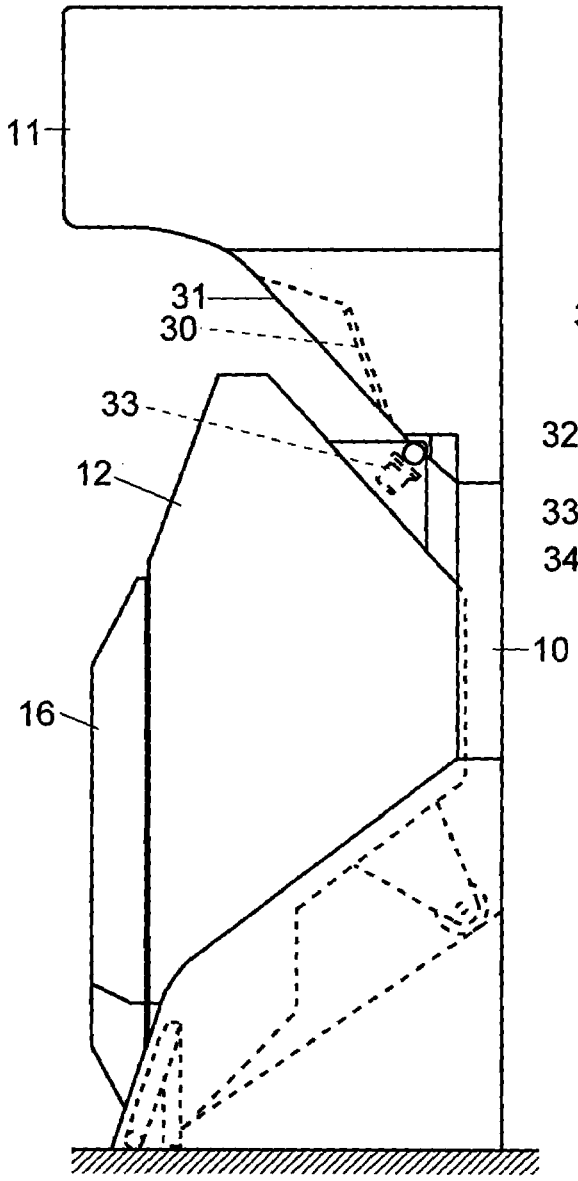
FIG. 13A is a side view.
Figure 13B:
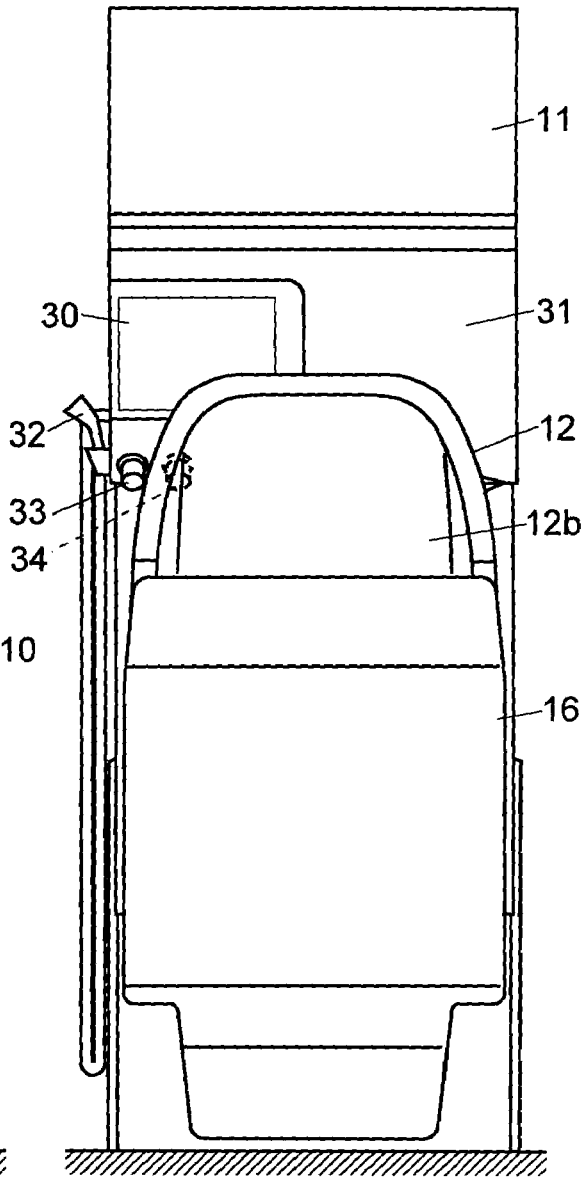
FIG. 13B is a front view of the main unit of the bathing aid of the embodiment with the bathtub in the stored state.

FIG. 13A is a side view, and FIG. 13B is a front view of the main unit 1 in the state where the bathtub 12 is stored. As shown in FIG. 13B, the main unit 1 has an operation panel 30 on the left side of the slope 31 under the tank 11, which panel is used to operate the main unit 1.

Figure 14:
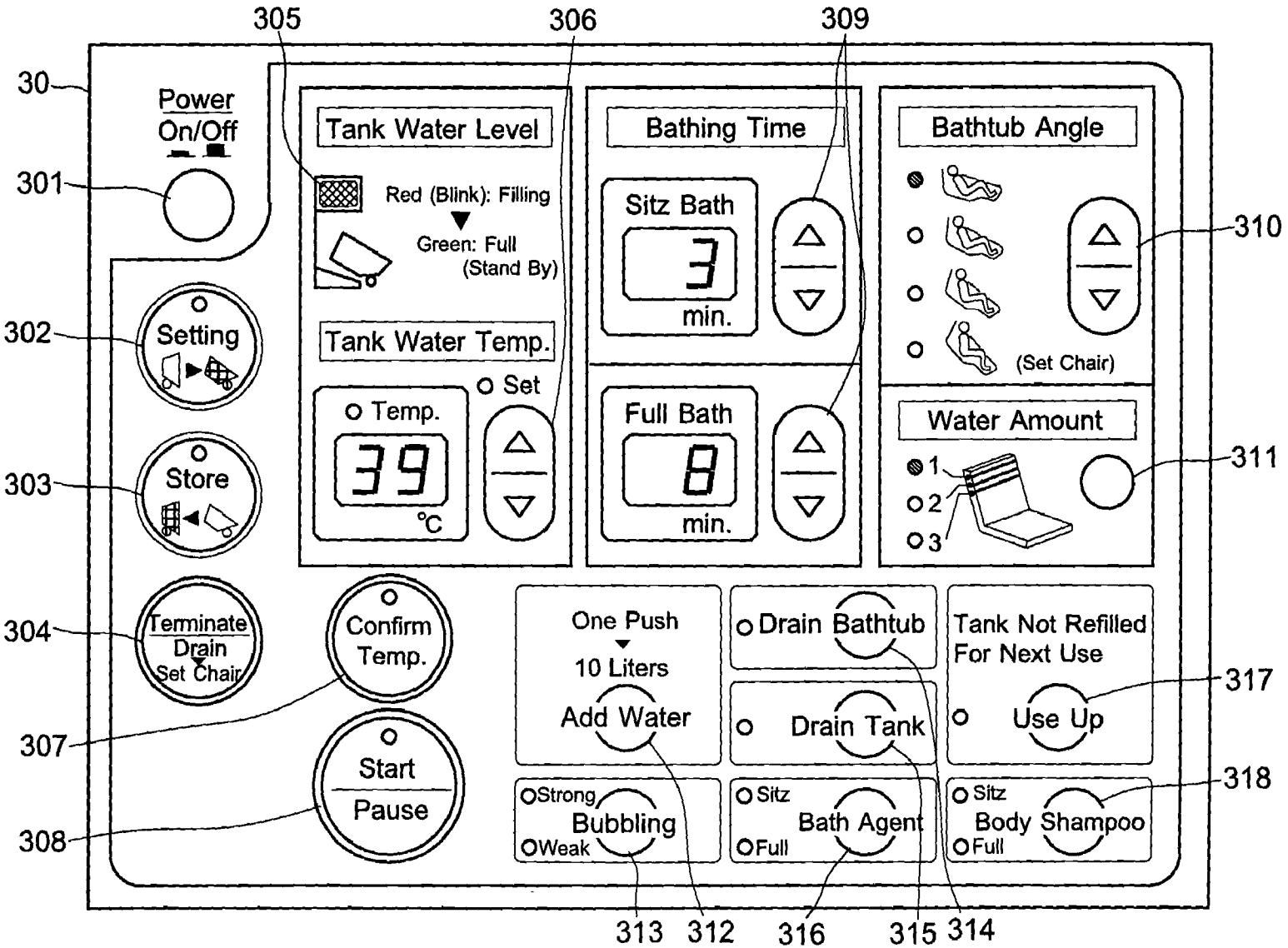
FIG. 14 is an enlarged view of the operation panel of the bathing aid of the embodiment.

FIG. 14 is an enlarged view of the operation panel 30. The operation panel 30 has the following keys and indicators: power switch 301; setting key 302; storage key 303; tank water amount check display 305; tank water temperature setting key 306 having a temperature indicator; temperature confirmation key 307; start key 308; bathing time setting key 309 having a time indicator; bathtub angle setting key 310 having an angle indicator; water amount setting key 311 having an amount selection indicator for bathtub water; bubbling key 313; bath agent injection key 316; use-up key 317; body shampoo injection key 318.

As shown in FIG. 13B, when the bathtub 12 is stored, the operation panel 30 is partially hidden behind the bathtub 12. It is not impossible to make operations, but it is also not easy because some indicators are hidden. Therefore, in the present apparatus, the keys that must be used when the bathtub 12 is in the stored state are arranged on the left side of the panel 30. These keys include the power switch 301, setting key 302, storage key 303, tank water amount check display 305 and tank water temperature setting key 306. This arrangement provides sufficient accessibility to the keys. On the left side viewed from the front, the main unit 1 has a showerhead 32 for supplying a shower of hot water. The main unit 1 also has a shower valve 33 and a shower temperature adjustment knob 34, both located under the operation panel 30.

The steps of supplying hot water into the bathtub and draining the bathtub by the present apparatus are described.

Figure 15:
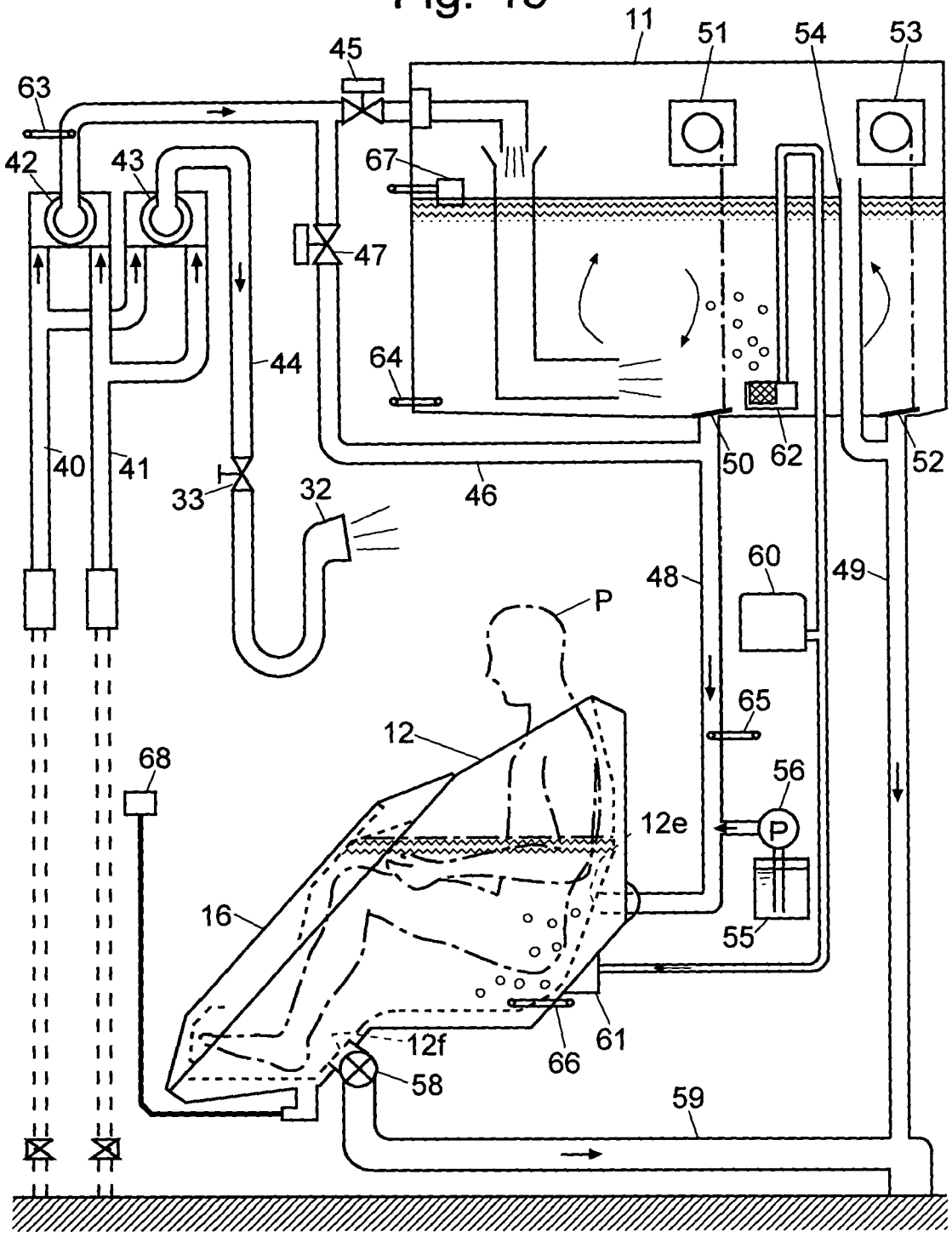
FIG. 15 is a diagram showing the piping for supplying and draining water in the present bathing aid of the embodiment.
Figure 16A:
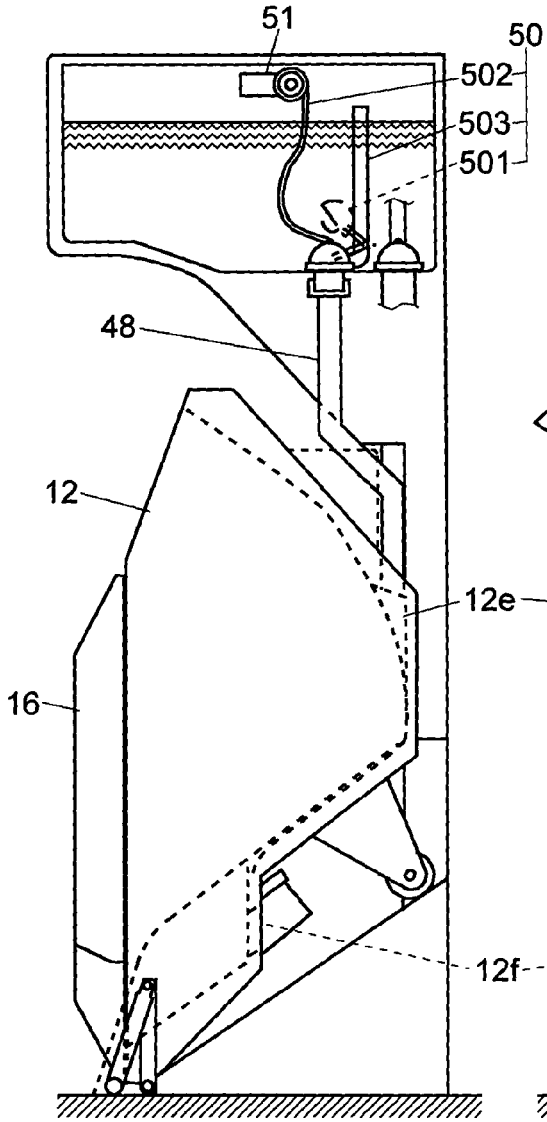
FIGS. 16A and 16B are structural drawings mainly showing the hot-water supply pipe of the bathing aid of the embodiment.
Figure 16B:
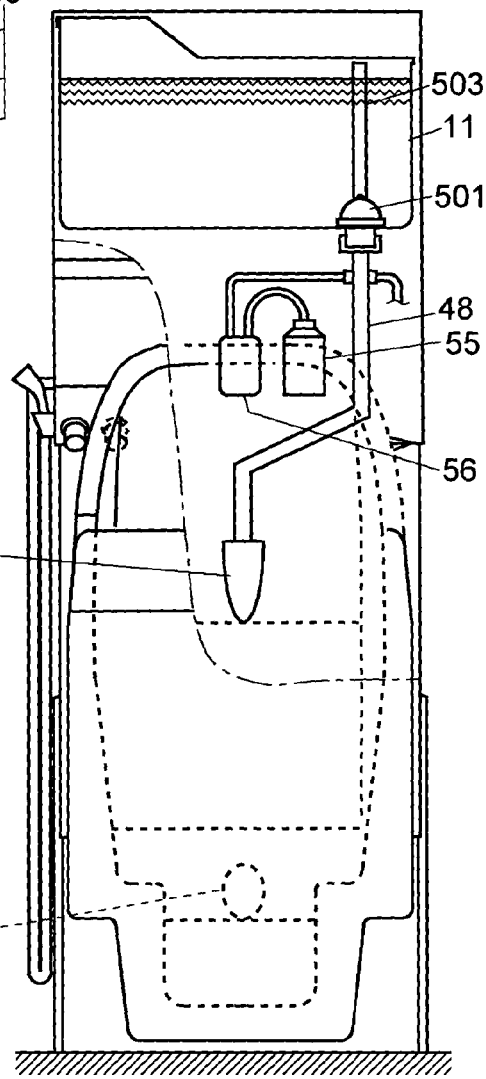
Figure 17:
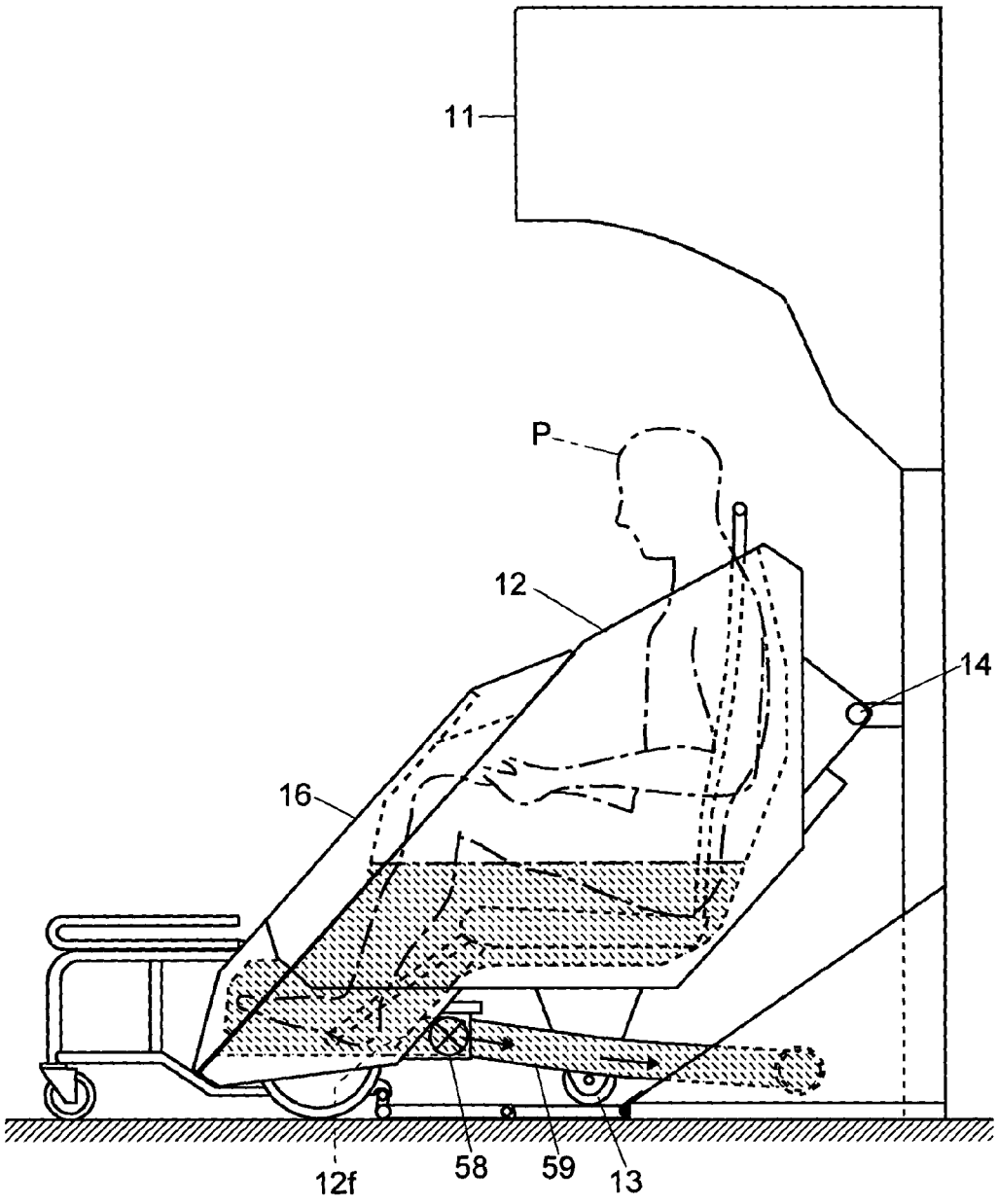
FIG. 17 is a side view of a drainage line of the bathing aid of the embodiment.
Figure 18:
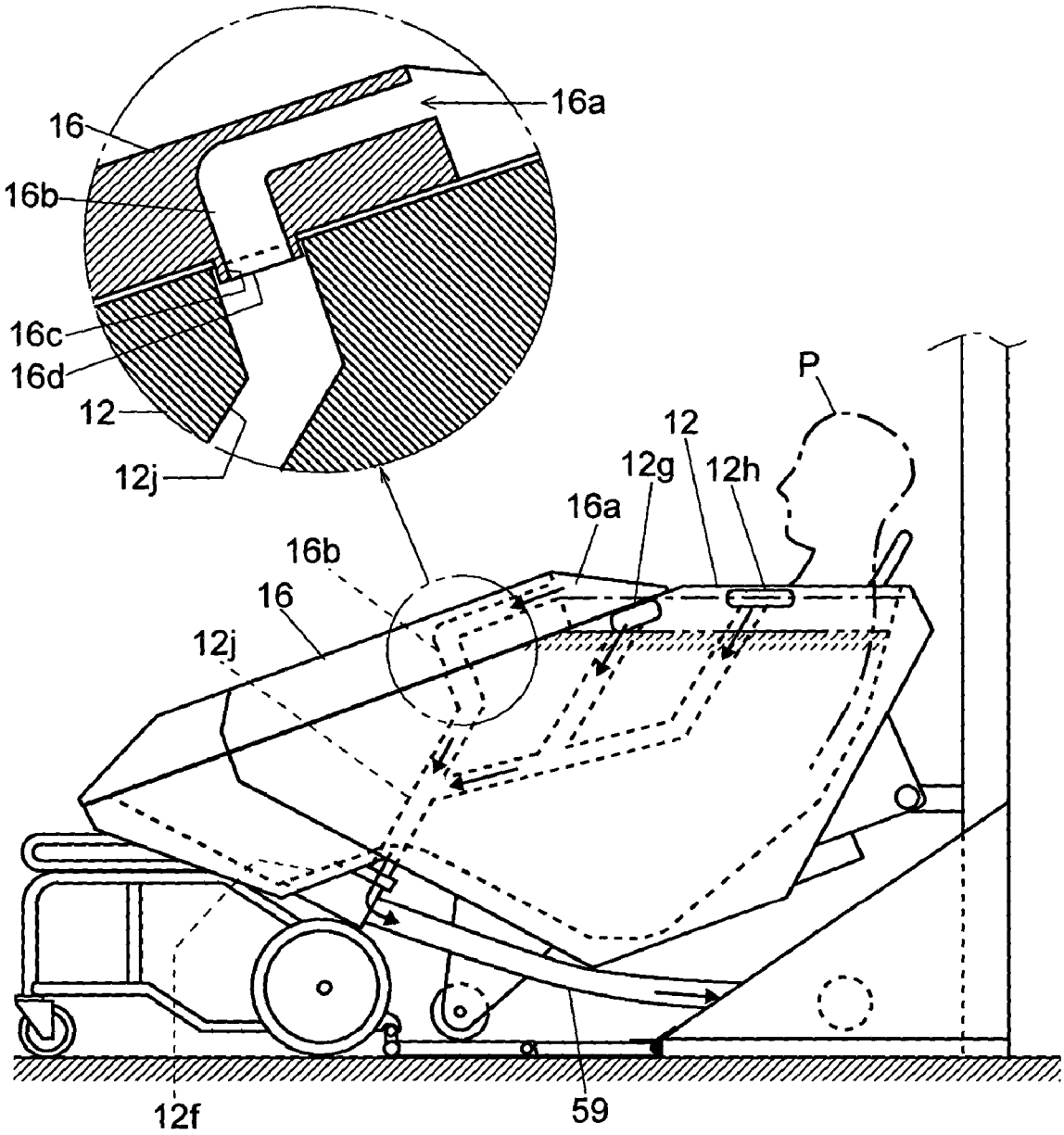
FIG. 18 is a side view of a drainage line of the bathing aid of the embodiment.

FIG. 15 is a diagram showing the piping for supplying and draining water in the present apparatus, FIGS. 16A and 16B are structural drawings showing the hot-water supply pipe, and FIGS. 17 and 18 are side views showing the drainage lines.

In FIG. 15, the hot-water supply pipe 40 leading to an external hot-water supply system, and the water supply pipe 41 leading to a faucet, are connected to mixing valves (thermo-mixing valve) 42 and 43. The second mixing valve 43 mixes hot and cold water to produce hot water having an appropriate temperature. The hot water flows through the shower pipe 44 and is spouted from the showerhead 32. The first mixing valve 42 similarly produces hot water having an appropriate temperature, which is supplied through an electromagnetic valve 45 into the tank 11. The hot water is also supplied through the bypass pipe 46 having a bypass valve 47 to a hot-water supply pipe 48.

The tank 11 has a hot-water supply port leading to the hot-water supply pipe 48 and a drainage port leading to a drainage pipe 49, both formed at the bottom of the tank 11. The two ports are provided with a hot-water supply valve 50 and a tank water drainage valve 52, which are opened or closed by the torque motors 51 and 53, respectively. As shown in FIGS. 16A and 16B, the hot-water supply valve 50 is composed of a hemispherical valve body 501, a chain 502 pulled by a pulley 503 according to the operation of the torque motor 51, and a communication pipe 504 for the communication between the space under the valve body 501 and the atmosphere.

When the torque motor 51 is energized to rotate the pulley 503 and pull the chain 502, the valve body 501 is pulled open against the water pressure. At this moment, air is introduced through the communication pipe 504 into the hot-water supply pipe 48, so that the pressure in the hot-water supply pipe 48 does not become negative. Therefore, the valve body 501 can be smoothly pulled up, allowing the hot water in the tank 11 to flow into the hot-water supply pipe 48. When the torque motor 51 is stopped and, accordingly, the chain 502 is loosened, the valve body 501 is closed by the water pressure. At this moment, the air escapes from the hot-water supply pipe 48 into the communication pipe 504, so that the valve body 501 assuredly closes the hot-water supply port. It should be noted that the tank water drainage valve 52 operates in a similar way.

In the middle of the hot-water supply pipe 48, the apparatus has a liquid dispenser for automatically injecting a body shampoo and/or bath agent into the hot water. In the present embodiment, the liquid dispenser consist of a bottle 55 for storing a liquid bath agent and a pump 56 for pumping the liquid from the bottle 55 into the hot-water supply pipe 48. An example of the pump 56 is a tube pump having a tube containing a liquid, rollers for squeezing the tube so that the liquid is pushed in the rolling direction, and a motor for driving the rollers. The present apparatus has two liquid dispensers corresponding to the body shampoo and the bath agent, respectively. It is possible to construct a mechanism using a single pump and a clutch or similar device for selectively drawing and supplying a liquid from either the shampoo bottle or bath agent bottle. The hot water supplied through the hot-water supply pipe 48 is spouted from the hot-water supply port 12*e* into the bathtub 12.

The water stored in the bathtub 12 can be drained through the drainage port 12*f* located in the front part of the bottom of the bathtub 12. The drainage port 12*f* leads to an external drain ditch through a drainage pipe 59 that is contractible and expansible like a bellow. When the drainage valve 58 located close to the drainage port 12*f* is opened, the water in the bathtub 12 is drawn into the drainage pipe 59 and discharged to the outside. In the stored state (FIG. 1) or normal bathing state (FIG. 3), the drainage port 12*f* is not at the lowest level within the bathtub 12; it comes to the lowest level only when the bathtub 12 is in the setting state. Therefore, to completely drain the water from the bathtub 12, the drainage valve 58 must be opened in the setting state.

If the bathtub 12 overflows with the water during the water supply time or bathing time, the water will spill over onto the floor around the main unit 1. To avoid this situation, two overflow ports 12*g* and 12*h* are formed in the inner wall of the bathtub 12, as shown in FIG. 18. These overflow ports 12*g* and 12*f* lead to the drainage pipe 59 through the overflow pipe 12*j* formed in the sidewall of the bathtub 12. When the water in the bathtub 12 reaches a level higher than the overflow ports 12*g* and 12*h*, a part of the water enters the overflow ports 12*g* and 12*h*, flows through the overflow pipe 12*j* and the drainage pipe 59, and is discharged to the outside. The cover 16 is also provided with an overflow port 16*a*, which leads to an overflow pipe 16*b* formed in the cover 16. When the cover 16 is closed, the overflow pipe 16*b* is connected to the overflow pipe 12*j* of the bathtub 12. Thus, the overflow port 16*a* also leads to the drainage pipe 59.

The outlet 16*d* of the overflow pipe 16*b* of the cover 16 is connected to the inlet formed in the upper end of the bathtub 12, as shown in FIG. 18. The flange 16*c* at the circumference of the outlet 16*d* is designed to project into the inlet of the bathtub 12. This design ensures that the water spouted from the outlet 16*d* enters the overflow pipe 12*j*, being prevented from penetrating into the space between the cover 16 and the bathtub 12 leaking to the outside.

The present apparatus has an air pump 60 for generating bubbles. The air pump 60 supplies air into two pipes, one connected to a bubble generator 61 for sending air into the bathtub 12, and the other connected to a bubble generator 62 for sending air into the tank 11. The bubble generator 61 is used mainly for providing cleaning effect (or moderate massaging effect) on the body surface of the bather during bathing, and the bubble generator 62 is used for stirring the hot water in the tank 11 to equalize the temperature of the hot water.

In FIG. 15, temperature sensors 63, 64, 65, and 66, each consisting of a thermistor for detecting the temperature of the hot-water, are located in the outlet of the first mixing valve 42, in the tank 11, in the hot-water supply pipe 48 and in the bathtub 12, respectively. Furthermore, the tank 11 has a tank water level sensor 67 for determining whether the tank is full, and also the bathtub 12 has a bathtub water level sensor 68 for detecting the water level in the bathtub 12.

Figure 19:
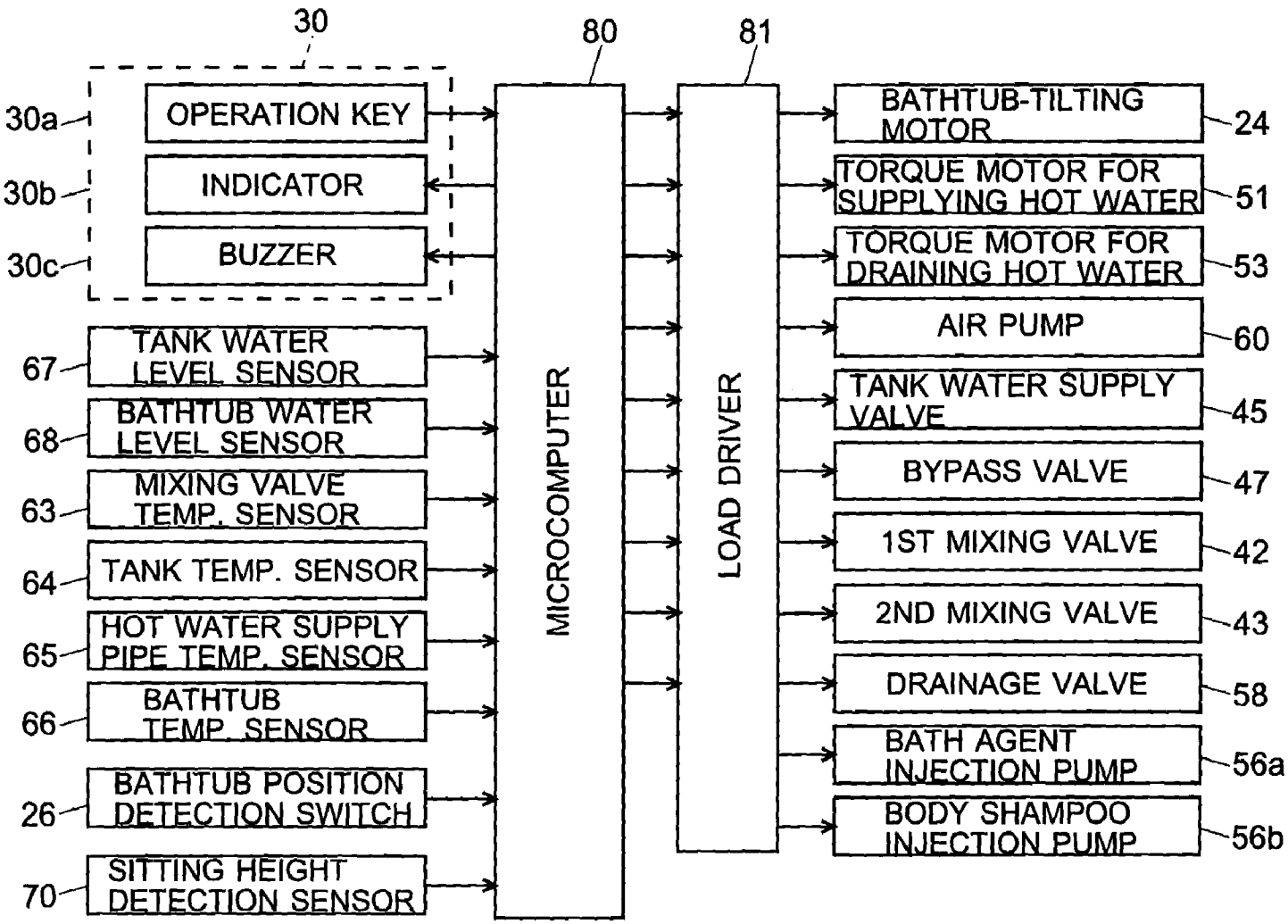
FIG. 19 shows the general construction of the electrical system of the bathing aid of the embodiment.

FIG. 19 shows the general construction of the electrical system of the present apparatus. The core of the system is a microcomputer 80, which receives various signals, including key input signals from various operation keys 30*a* of the operation panel 30, level detection signals from the tank water level sensor 67 and the bathtub water level sensor 68, temperature detection signals from the mixing valve temperature sensor 63, the tank temperature sensor 64, the supply pipe temperature sensor 65 and the bathtub temperature sensors 66, sitting height detection signals from the sitting height sensor 70, and bathtub position signals from the bathtub position detection switches 26. As is generally known, microcomputers has random access memory (RAMs) and read only memories (ROMs), and ROMs hold pre-installed control programs. With a control program running, the microcomputer 80 receives the aforementioned signals, and controls the load driver 81 to drive the following elements: the bathtub-tilting motor 24, the torque motor 51 for supplying hot water into the bathtub 12, the torque motors 53 for draining hot water from the tank 11, the air pump 60, the tank water supply valve 45 for controlling the hot-water supply into the tank 11, the first mixing valve 42 for regulating the temperature of the hot water supplied into the tank 11, the bypass valve 47, the second mixing valve 43 for regulating the temperature of the hot water supplied to the showerhead, the drainage valve 58 for draining hot water from the bathtub 12, the bath agent injection pump 56*a* for injecting a bath agent into the hot water flowing into the bathtub 12, and the body shampoo injection pump 56*b* for injecting a body shampoo into the hot water flowing into the bathtub 12.

Figure 20:
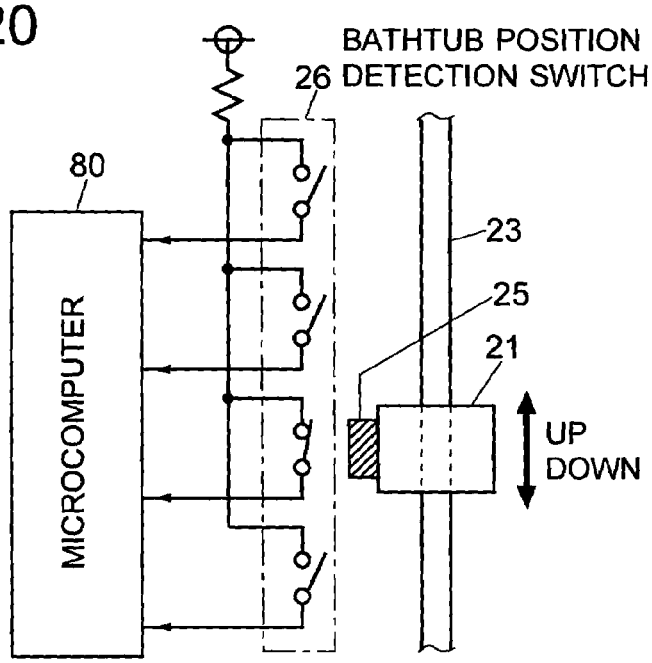
FIG. 20 is a circuit diagram showing the relation between the microcomputer and the bathtub position detection switches in the bathing aid of the embodiment.

FIG. 20 is a circuit diagram showing the relation between the microcomputer 80 and the bathtub position detection switches 26. The four bathtub position detection switches 26 depicted in FIG. 20 are the four reed switches depicted in FIG. 6.

Figure 21:
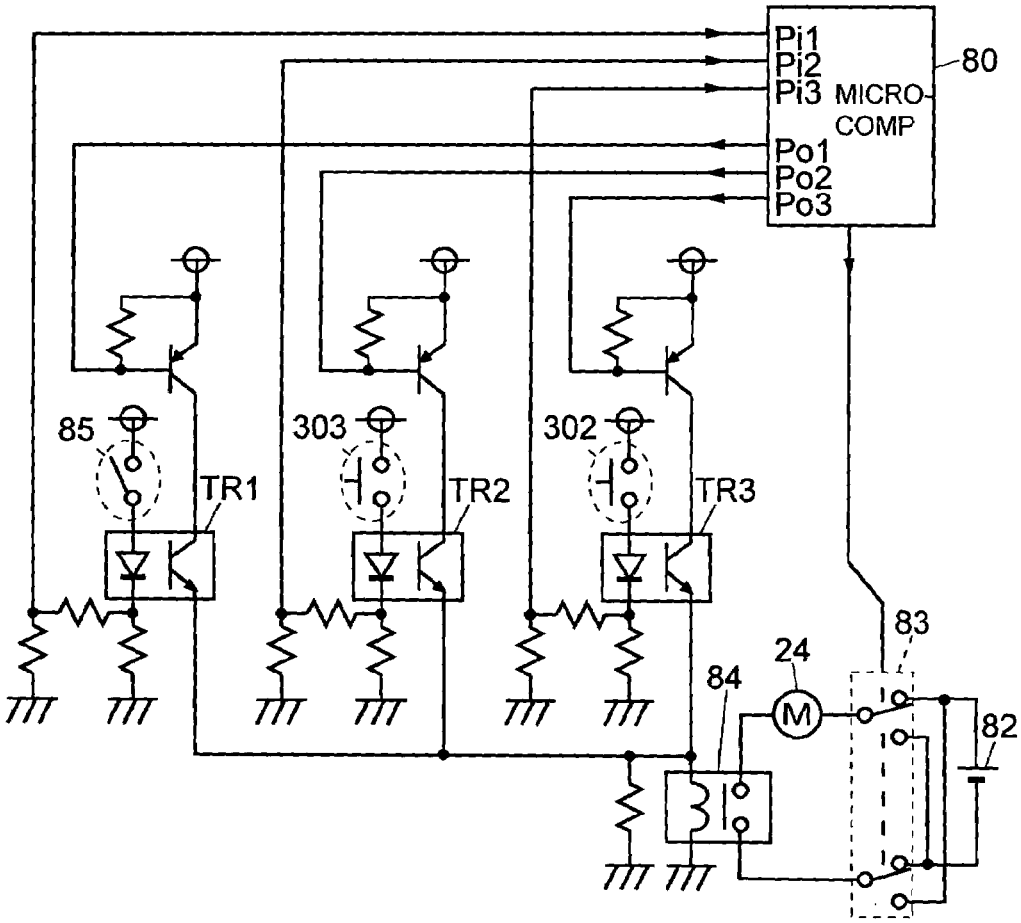
FIG. 21 is a circuit diagram of the main part relevant to the operation of the motor for tilting the bathtub in the bathing aid of the embodiment.

The present apparatus is designed so that it will never endanger the caregiver or other persons present by making abnormal operations even if the microcomputer 80 runaways due to an external noise or other factors while changing the orientation of the bathtub 12 between the stored state and the setting state. FIG. 21 is a circuit diagram of the main part relevant to the operation of the motor 24.

The motor 24 is connected to the power source 82 via an electromagnetic relay 84 and a polarity inversion switch 83. The polarity inversion switch 83 is switched by a control signal from the microcomputer 80. Switching of the polarity changes the rotating direction of the motor 24, which in turn changes the direction of the vertical movement of the bathtub 12 (or the movable unit 21). To the coil of the electromagnetic relay 84, three current supply circuits are connected in parallel; one circuit includes the setting key 302 and a third photo-coupler TR3, another circuit includes the storage key 303 and a second photo-coupler TR2, and the other circuit includes a switch 85 and a first photo-coupler TR1. When a current is supplied from one of the three circuits, the electromagnetic relay 84 turns ON and supplies a driving current to the motor 24.

Figure 22A:
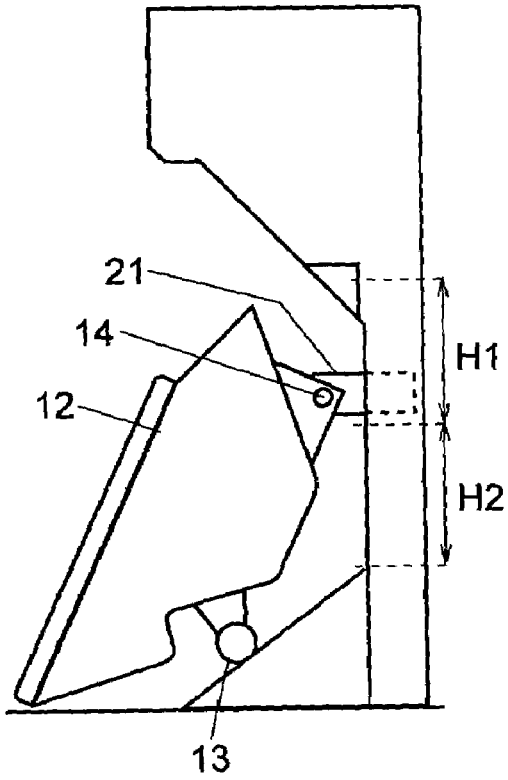
FIGS. 22A–22C show the construction of the switch shown in FIG. 21, where
Figure 22B:
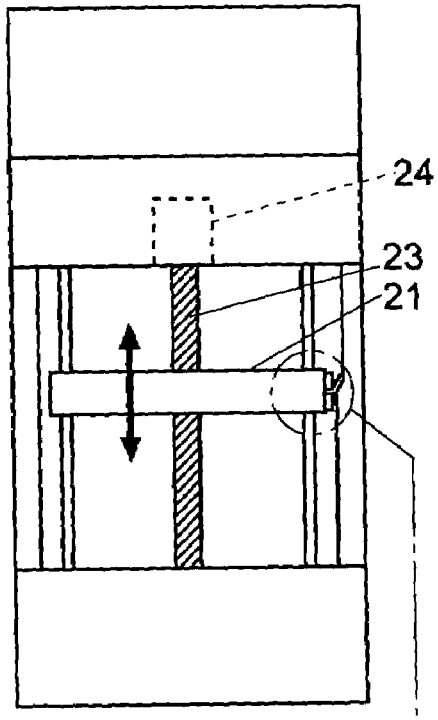
Figure 22C:
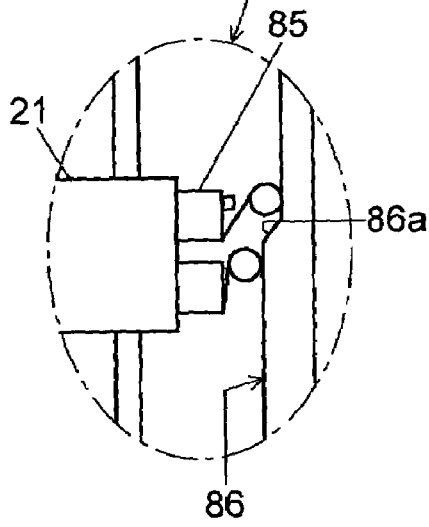

FIGS. 22A–22C show the construction of the switch 85 shown in FIG. 21, where FIG. 22A is a general side view of the main unit, FIG. 22B is a front view without the bathtub 12, and FIG. 22C is an enlarged view of a part of FIG. 22B. As shown in FIG. 22C, a guide wall 86 having a step 86*a* is formed one side of the pillar 10 located on one side of the movable unit 21 which moves vertically along the screw shaft 23. The movable element of the switch 85 fixed on the aforementioned side of the movable unit 21 receives no force from the guide wall 86 when it is higher than the step 86*a*, and receives a pressing force from the guide wall 86 when it is lower than the step 86*a*. In other words, the switch 85 is open when the movable unit 21 is higher than the step 86*a* (i.e. when it is within the range H1 in FIG. 22A), and is closed when the movable unit 21 is lower than the step 86*a* (i.e. when it is within the range H2 in FIG. 22A).

The opening/closing of the switch 85 can be checked by the signal coming from the input port Pi1 of the microcomputer 80. When the switch 85 is closed, the output transistor of the first photo-coupler TR1 is ON, so that the opening/closing of the electromagnetic relay 84 can be controlled by sending an output signal through the output port Po1, irrespective of whether the other two current supply circuits are working or not. This means that the microcomputer 80 can spontaneously control the operation of motor 24, or the tilting motion of the bathtub 12.

When the movable unit 21 is within the range H1 and the switch 85 is accordingly open, the output transistor of the photo-coupler TR1 is OFF, so that this current supply circuit is irrelevant to the opening/closing of the electromagnetic relay 84. The output transistors of the photo-couplers TR2 and TR3 included in the other two current supply circuits, on the other hand, turn ON only when the storage key 303 or the setting key 302 is pressed. Therefore, even when the microcomputer 80 supply a voltage to the output port Po2 or Po3 for supplying a current to the coil, the electromagnetic relay 84 never turns ON if neither the storage key 303 nor the setting key 302 is pressed at the moment. This means that, when the movable unit 21 is within the range H1, it is always necessary to manually press the storage key 303 or the setting key 302 to change the orientation of the bathtub 12. Thus, there is little possibility that an unsafe situation occurs due to an abnormal operation caused by a problem of the microcomputer 80 or other factors.

The motor 24 runs only during the period the storage key 303 or the setting key 302 is pressed. In the course of the tilting motion of the bathtub 12, if the caregiver feels some danger and releases the key, the bathtub 12 immediately stops. This is another aspect of the high level of safety ensured by the present apparatus.

When the movable unit 21 is within the range H2, the tilting motion of the bathtub 12 is controlled by the microcomputer 80. Normally, the maximally tilted position is the normal bathing state, as shown in FIG. 3, where the upper edge of the opening 12*b* of the bathtub 12 is almost horizontal. It is possible, however, that bathtub 12 goes beyond that position because of a runaway of the microcomputer 80 or breakage of mechanical parts such as the ball screw. To prevent this situation, the screw shaft 23 has a stopper 27 at its lower end, which mechanically stops the movable unit 21 and prevents it from further lowering.

In the present apparatus, an appropriate amount of hot water is stored in the bathtub 12, and the bather bathes in the hot water. When, for example, the hot water is intended to be stored up to the shoulder blades, the amount of necessary hot water varies depending on the body size of the bather, especially on the sitting height. Though the amount of the hot water can be determined as desired as described later, it is possible that the head of the bather submerges under water in the bathtub 12 if the bather has an extraordinarily short sitting height. Therefore, use of the present apparatus is limited to those who are more than about 140 cm tall. To take into account the personal difference in sitting height and other body size, and to further improve the safety, the present apparatus is provided with a sitting height detection sensor 70.

Figure 23A:
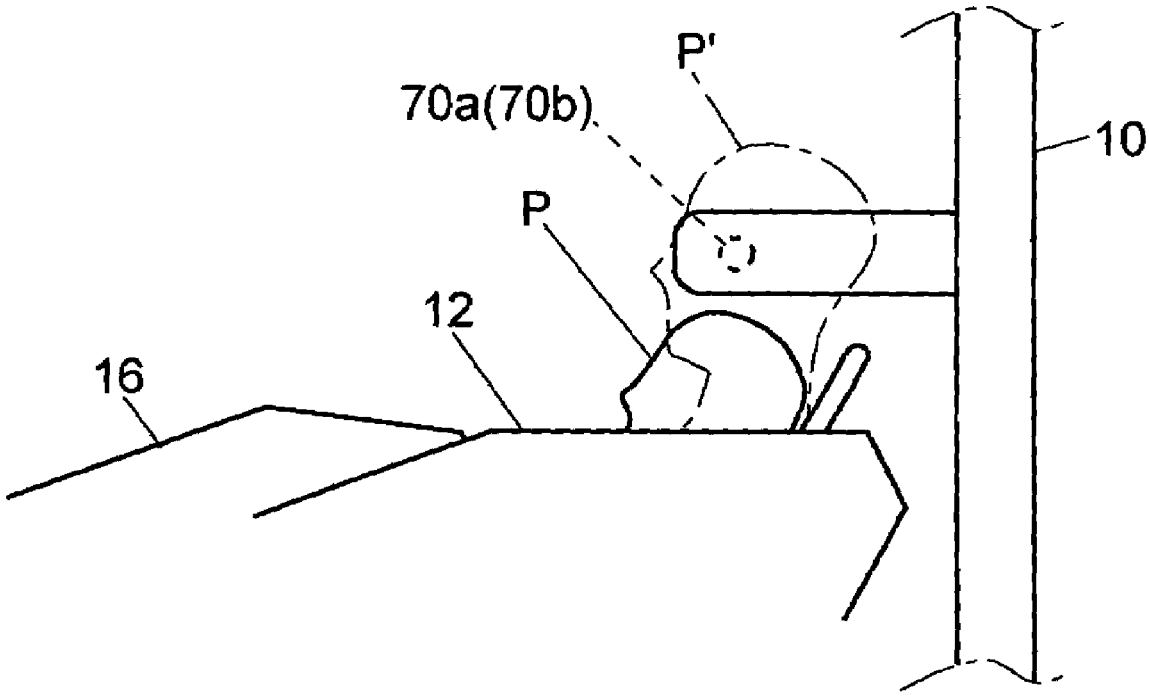
FIGS. 23A and 23B are outlined views of the main part of the sitting height detection sensor in the bathing aid of the embodiment, where
Figure 23B:
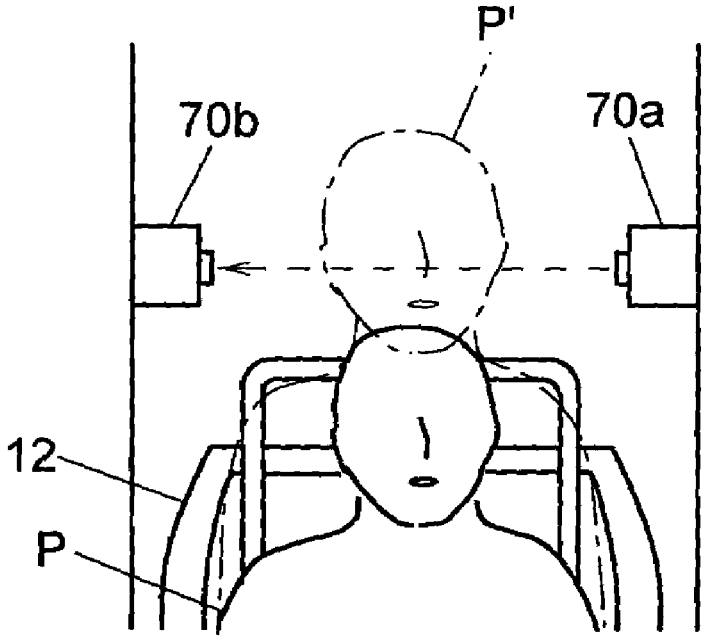
Figure 24:
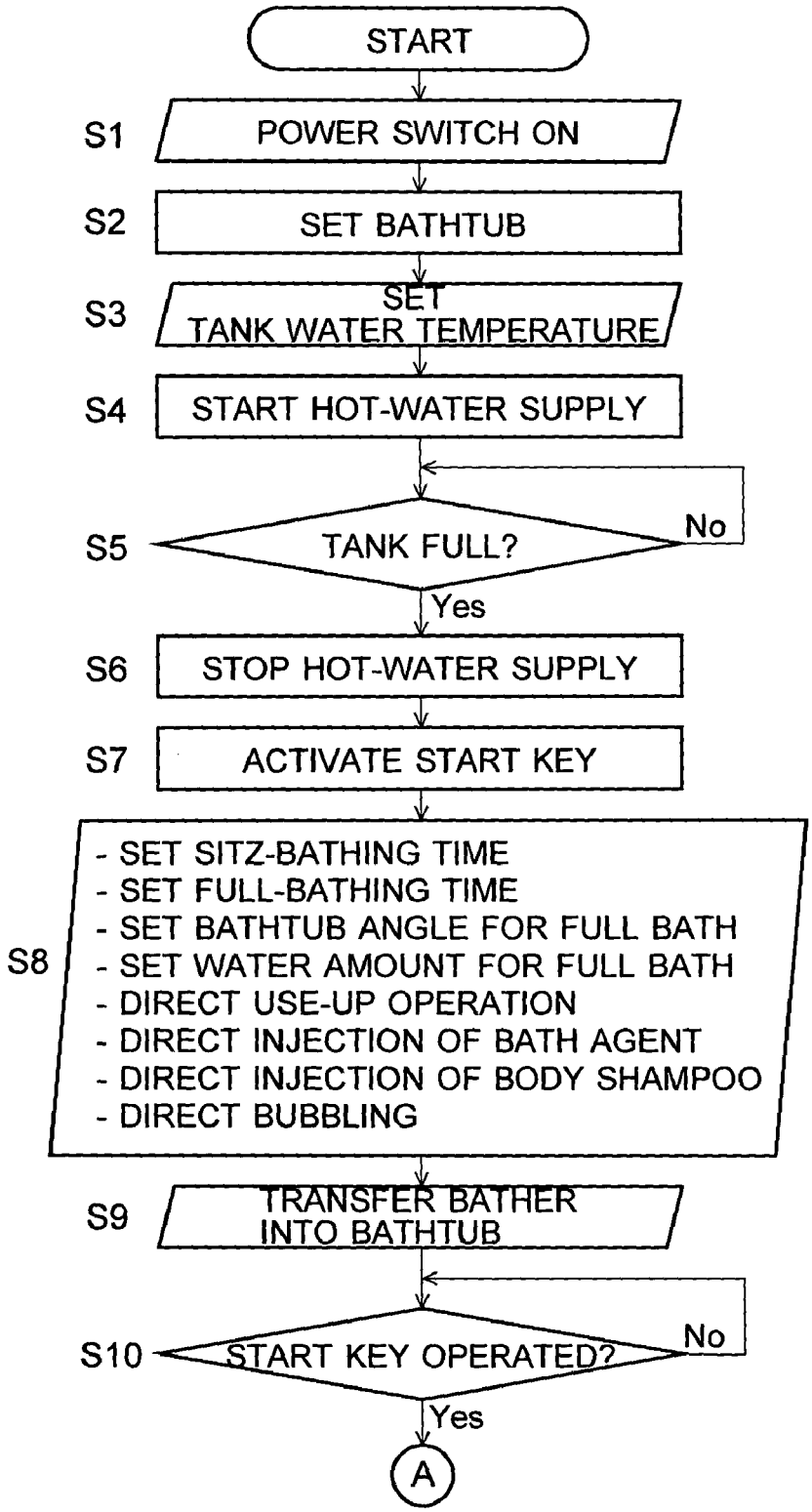
FIG. 24 is a flowchart showing the steps for caregivers to let a bather take a bath with the present bathing aid of the embodiment.
Figure 25:
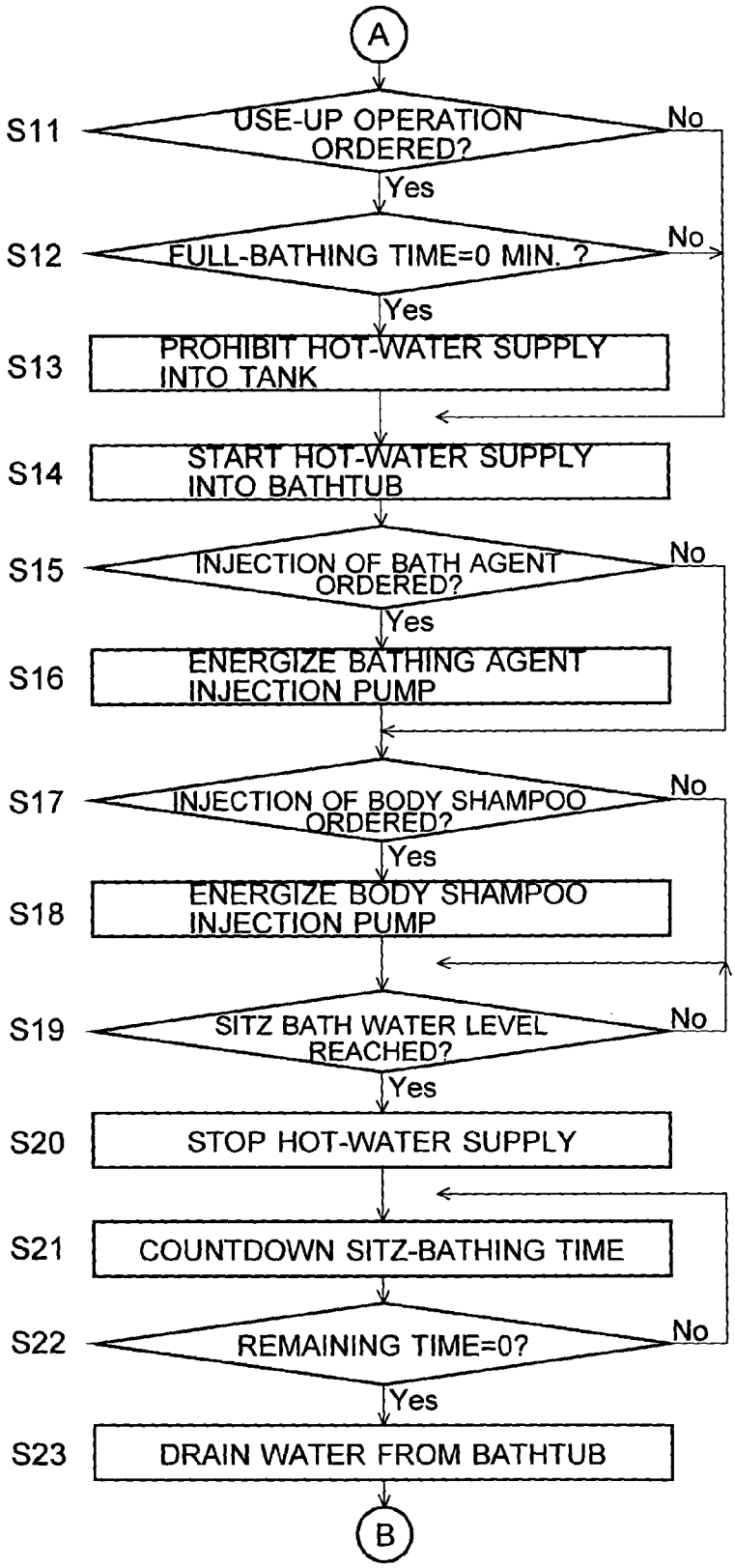
FIG. 25 is a flowchart showing the steps for caregivers to let a bather take a bath with the present bathing aid of the embodiment.
Figure 26:
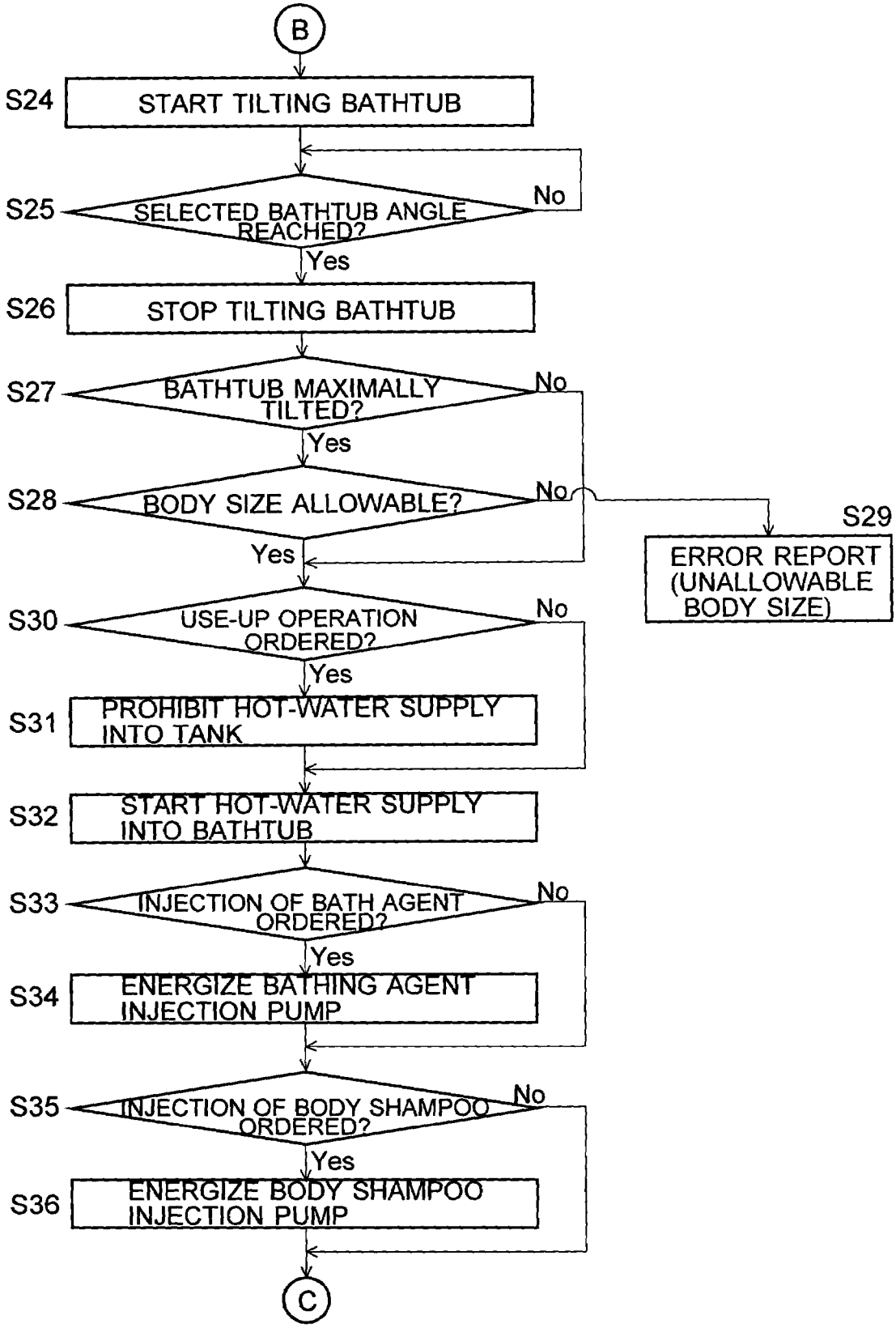
FIG. 26 is a flowchart showing the steps for caregivers to let a bather take a bath with the present bathing aid of the embodiment.
Figure 27:
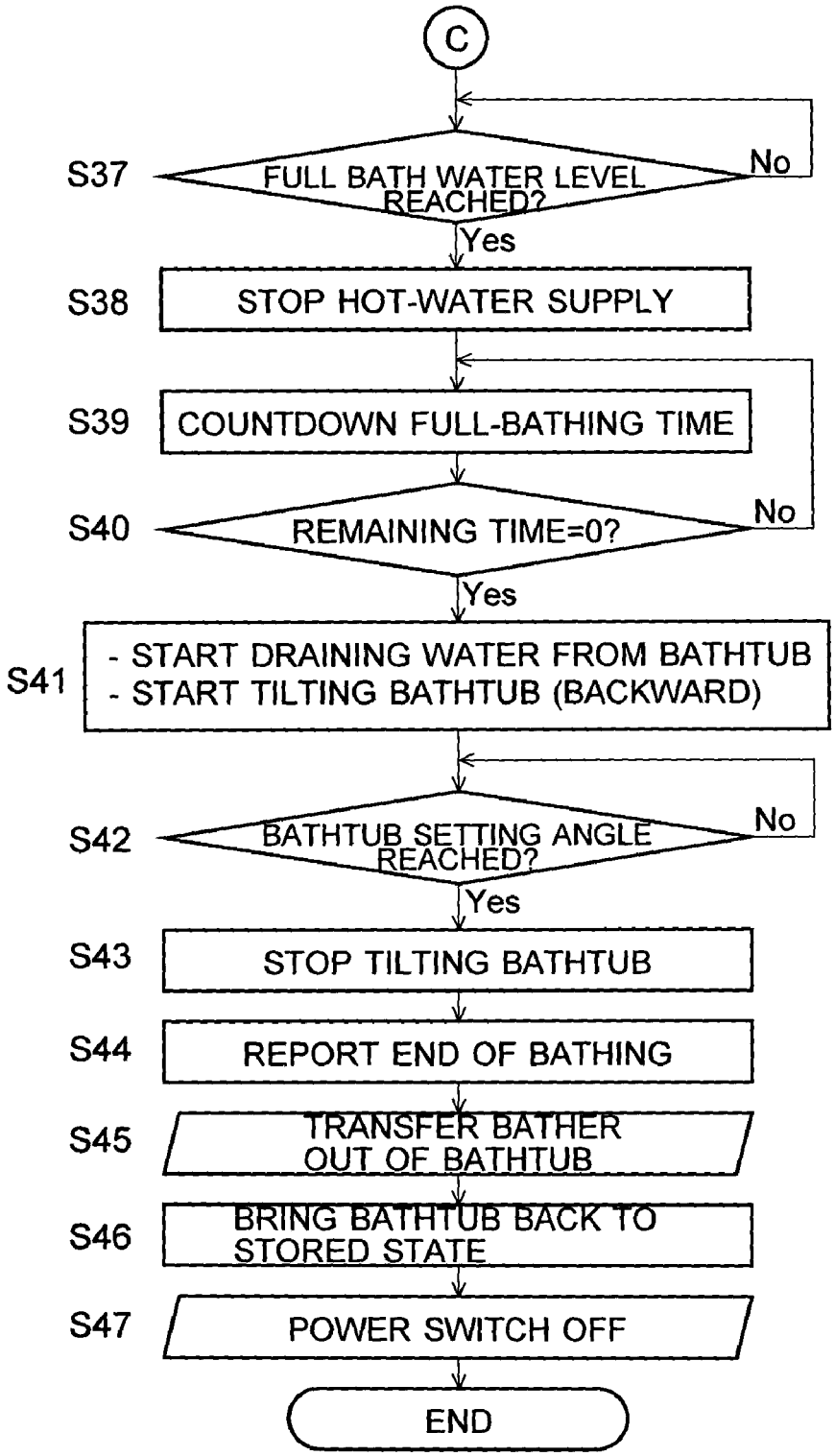
FIG. 27 is a flowchart showing the steps for caregivers to let a bather take a bath with the present bathing aid of the embodiment.

FIGS. 23A and 23B are outlined views of the main part of the sitting height detection sensor 70, where FIG. 23A is a side view and FIG. 23B is a front view. The sensor 70 includes an infrared emitter 70*a* and an infrared detector 70*b* located at both sides of the bather P or P' in the bathtub 12 at the level where the infrared beam emitted by the infrared emitter 70*a* is blocked by the head of the bather in the normal bathing state, as denoted by P' in FIGS. 23A and 23B, if the bather has an allowable body size. When the bather has an unallowable body size, as denoted by P in FIGS. 23A and 23B, the head does not block the infrared beam, which is accordingly detected by the infrared detector 70*b*. Thus, based on the detection signal of the infrared detector 70*b*, it is possible to automatically determine whether the bather has an allowable body size.

The operations of the present apparatus are described.

Referring to the flowcharts in FIGS. 24–27, the steps for caregivers to allow a bather take a bath with the present apparatus is described. It is assumed that the bathtub 12 of the apparatus is initially in the storage position, as shown in FIG. 1.

The caregiver presses the power switch 301 on the operation panel 30 of the main unit 1 to turn on the power (Step S1). Then, electric power is supplied to the microcomputer 80 and other electrical circuits, and a predetermined control program is executed on the microcomputer 80. The program performs an initializing process, in which the setting key 302 is enabled. When the caregiver presses the setting key 302, the load driver 81 drives the bathtub tilting motor 24 while the key 302 is pressed. The rotation of the motor 24 produces the downward motion of the movable unit 21, which in turn drives the bathtub 12 to tilt toward the position where the open top 12*a* is directed upward. The motor 24 is stopped when the bathtub 12 has reached the predetermined setting position. Thus the setting process is completed (Step S2).

Next, the caregiver appropriately sets the temperature of the hot water, using the tank water temperature setting key 306 (Step S3). In response to this operation, the tank water supply valve 45 is opened to start supplying hot water into the tank 11, while regulating the mixing ratio of the hot and cold water with the first mixing valve 42 (Step S4). When a signal from the tank water level sensor 67 is detected, the tank is full of water, so that the tank water supply valve 45 is closed to stop supplying hot water into the tank 11 (Steps S5, S6). After the water supply is stopped, the operation keys are enabled (Step S7). Now, the caregiver can use the bathing time setting keys 309 to set the bathing time for "sitz bath" or "full bath", the bathtub angle setting key 310 to set the bathtub angle for full bath, and the water amount setting key 311 to set the amount of hot water for full bath. If necessary, the caregiver may use the use-up key 317 to order the use-up operation (which will be described later), the bath agent injection key 316 to order automatic injection of a bath agent, the body shampoo injection key 318 to order automatic injection of a body shampoo, and/or the bubbling key 313 to order the use of the bubbling (Step S8).

After making all the necessary settings, the caregiver transfers the bather P into the bathtub 12, and closes the cover 16 (Step S9). For example, a bather P lying on a bed is helped into the seat unit of the wheelchair 2, which is moved toward the bathtub 12 from the front, and the bogie unit 210 is temporarily fastened to the main unit 1. From this state, the seat unit 220 with the bather P sitting thereon is slid back toward the main unit 1, and transferred into the bathtub 12. After the bather P is completely transferred into the bathtub 12, the cover 16 is closed and locked. Thus, the bathtub 12 is tightly closed by the cover 16, with the head of the bather P sticking out through the opening 12*b*.

The above-described steps correspond to the preparation for bathing and include various jobs to be done by the caregiver. After that, the present apparatus performs an automatic operations relating to the bathing. To start the operation, the caregiver presses the start key 308 (Step S10). In response to this key operation, the microcomputer 80 checks whether the use-up operation is ordered (Step S11). The use-up operation uses up the hot water in the tank 11, on the assumption that nobody else will bathe after the current bather.

When the use-up operation is ordered, it is determined whether the full-bathing time is set zero minutes (Step S12). In a use-up operation, when the full-bathing time is set zero, meaning that the bathing mode is the "sitz bath," it is not necessary to refill the tank 11 after supplying the hot water into the bathtub 12. Therefore, the water supply into the tank 11 is prohibited (Step S13). On the other hand, when the use-up operation is not ordered, or when the use-up operation is ordered and the full-bathing time is not zero, the process goes to Step S14, where the torque motor 51 for supplying hot water is energized to open the hot-water supply valve 50 to start supplying hot water from the tank 11 into the bathtub 12. If the water supply into the tank 11 has not been prohibited in Step S13, the tank 11 is supplied with additional hot water to make up for the hot water supplied from the tank 11 into the bathtub 12. This mechanism will be described later.

After the start of the hot-water supply, it is determined whether the injection of the bath agent is ordered (Step S15). When the injection of the bath agent is ordered, the bath agent injection pump 56*a* is energized (Step S16). It is also determined whether the injection of the body shampoo is ordered (Step S17), and the body shampoo injection pump 56*b* is energized if the injection of the body shampoo is ordered (Step S18). The bath agent injection pump 56*a* and the body shampoo injection pump 56*b* take in the bath agent and/or body shampoo held beforehand in the containers, and inject it into the hot-water supply pipe 48. At the moment the hot water is spouted into the bathtub 12, the hot water is already mixed with the bath agent and/or body shampoo. As the hot water is collected in the bathtub 12, the water level in the bathtub 12 gradually increases.

The microcomputer 80 monitors the water level in the bathtub 12 with the bathtub water level sensor 68. When the water has reached a predetermined level for sitz bath ("Yes" in Step S19), the hot-water supply valve 50 is closed to stop supplying the hot water (Step S20). At this moment, the water level is such that the body of the bather P in the bathtub 12 is immersed up to the waist. Then, the countdown of the sitz-bathing time initially set by the caregiver is started, which is continued until the remaining time runs out (Steps S21, S22). When the sitz-bathing time has run out, the drainage valve 58 is opened to discharge the hot water from the bathtub 12 (Step S23). In the case of the sitz bath mode, the bathtub 12 is in the setting state, as shown in FIG. 17, and the drainage port 12*f* is at the lowest point within the bathtub 12. Therefore, the water is completely drained from the bathtub 12.

Next, the microcomputer 80 again drives the bathtub tilting motor 24 through the load driver 81 to further tilt the bathtub 12 (Step S24). When the bathtub 12 has reached the bathtub angle that the caregiver has initially selected from the predetermined four bathtub angles ("Yes" in Step S25), the motor 24 is halted to stop the tilting motion of the bathtub 12 (Step S26). After that, it is determined whether the tilt angle of the bathtub 12 is maximal, i.e. whether the bathtub 12 is in the normal bathing state shown in FIG. 3 (Step S27). If the tilt angle is maximal, it is determined whether the body size, or sitting height, of the bather P is allowable for using the present apparatus, based on the detection signal from the sitting height sensor 70 (Step S28).

As described above, the present apparatus automatically supplies hot water into the bathtub 12, irrespective of the body size of the bather. Therefore, even with the minimal level of hot water in the bathtub 12, a portion of the bather's face may be immersed under the water when the bathtub 12 is at the maximal tilt angle, if the bather has a very short sitting height. Taking this into account, the body size of the bather is checked in Step S28. If the body size is not allowable, the error is reported to the caregiver with the buzzer 30*c* or other devices (Step S29). Thus, very high degree of safety is achieved.

When the body size of the bather P is allowable, it is determined whether the use-up operation is ordered (Step S30). When the use-up operation is ordered, it is not necessary to refill the tank 11 after supplying the hot water into the bathtub 12. Therefore, the water supply into the tank 11 is prohibited (Step S31). On the other hand, when the use-up operation is not ordered, or when the use-up operation is ordered and the full-bathing time is not set zero, the process goes to Step S32, where the torque motor 51 for supplying hot water is energized to open the hot-water supply valve 50 to start supplying hot water into the tank 11. If the water supply into the tank 11 has not been prohibited in Step S13, the tank 11 is supplied with additional hot water to make up for the hot water supplied from the tank 11 into the bathtub 12.

Next, similar to Steps S15–S18, the process goes through Steps S33–S36, where the bath agent and/or body shampoo is injected into the hot water flowing into the bathtub 12, if it is directed. Then, the microcomputer 80 monitors the water level in the bathtub 12 with the bathtub water level sensor 68. When the water level has reached a predetermined level for a full bath ("Yes" in Step S37), the hot-water supply valve 50 is closed to stop supplying the hot water (Step S38). Then, the countdown of the full-bathing time initially set by the caregiver is started, which is continued until the remaining time runs out (Steps S39, S40). When the sitz-bathing time has run out, the drainage valve 58 is opened to start discharging the hot water from the bathtub 12, and the bathtub tilting motor 24 is driven to return the bathtub 12 to the setting position (Step S41).

When the bathtub 12 has returned to the setting position ("Yes" in Step S42), the motor 24 is halted to stop the tilting motion of the bathtub 12 (Step S43). In the full-bathing position, the drainage port 12*f* of the bathtub 12 is not at the lowest point. In the setting position, on the other hand, the drainage port 12*f* is at the lowest position within the bathtub 12. Therefore, after a certain period of time from the returning of the bathtub 12 to the setting position, the water is completely drained from the bathtub 12. Then, the completion of the bathing is reported to the caregiver with the buzzer 30*c* or other devices (Step S44), so that the caregiver can immediately notice the completion of the bathing even when she or he is away from the apparatus, and the bather P will never be left unattended after the completion of the bathing.

After that, following the steps of transferring the bather P into the bathtub 12 in reverse, the caregiver slides the seat unit 220 with the bather P sitting thereon from the bathtub 12 to the bogie unit 210 of the wheelchair 2. Then, the caregiver releases the wheelchair 2 from the temporary locked state, and moves it away from the main unit 1 (Step S45). If there is another bather waiting, the process should return to Step S8 (if it is necessary to change the setting) or S9. If there is no other bather, the caregiver presses the storage key 303 to move the bathtub 12 back to the stored state. As explained above, the bathtub tilting motor 24 is driven only while the storage key 303 is being pressed. In this process, the supportive shaft 14 pulls the rear end of the bathtub 12 up to the storage position (Step S46). When the bathtub 24 has reached the storage position, the motor 24 is stopped; it will no longer work even if the storage key 303 is pressed. Finally, the caregiver presses the power switch 301 to turn off the main unit 1 (Step S47). Thus, all of the tasks relating to bathing are completed.

The basic operation of the present apparatus is as described above. Next, referring to the flowcharts in FIGS. 28–32, some control processes characterizing the present apparatus are detailed.

[Setting and Storing Bathtub]

Figure 28:
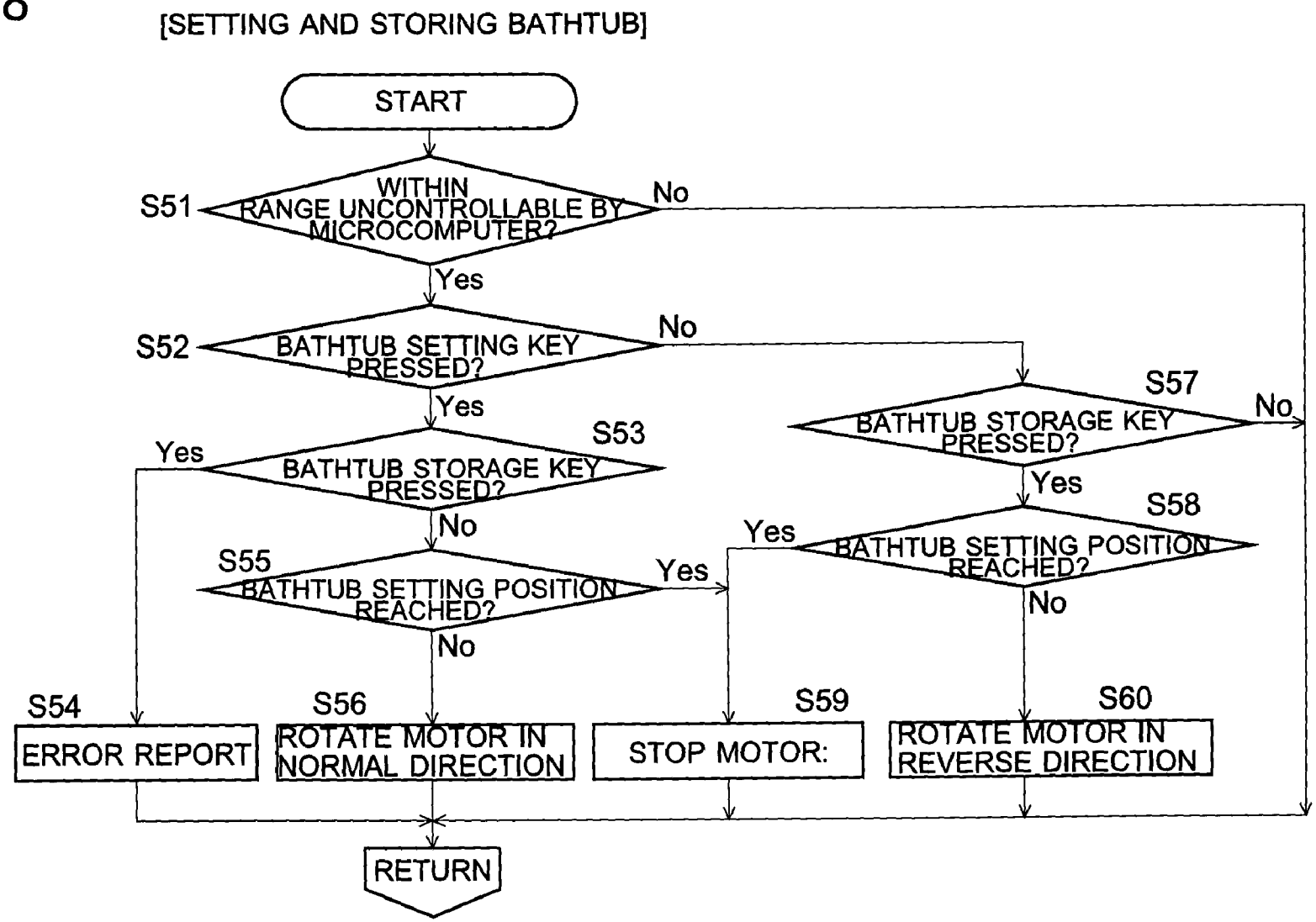
FIG. 28 is a flowchart showing the control process of tilting the bathtub from the stored position to the setting position, or in reverse, in the bathing aid of the embodiment.

FIG. 28 is a flowchart showing the control process of tilting the bathtub from the stored position to the setting position, or in reverse. The constructions shown in FIGS. 21 and 22 are relevant to this process.

The microcomputer 80 determines whether the switch 85 is ON or OFF, i.e. whether the movable unit 21 is within the range H1, based on the level of the input signal from the input port Pi1 (Step S51). If it is not within the range H1, the movable unit 21 must be within the range H2. In this case, the process immediately returns to some other step because the control process concerned hereby does not apply when the movable unit 21 is within H2. If the movable unit 21 is within the range H1, it is determined whether the setting key 302 is pressed, based on the level of the input signal from the input port Pi3 (Step S52). If the setting key 302 is pressed, the microcomputer 80 further determines whether the storage key 303 is pressed, based on the level of the input signal from the input port Pi2 (Step S53). If, in Step S53, the storage key 303 is found pressed, it means that both the setting and storage of the bathtub are simultaneously ordered. In this case, it is impossible to determine which order is correct, and the error is reported with the buzzer 30*c* or other device (Step S54).

If, in Step S52, the storage key 303 is not found pressed, it is then determined whether the bathtub 12 has reached the setting position at the moment (Step S55). If the bathtub 12 has not reached the setting position, the bathtub tilting motor 24 is rotated in the normal direction to lower the supportive shaft 14 so that the tilting angle of the bathtub 12 increases (Step S56). If, in Step S55, it is determined that the bathtub 12 has already reached the setting position, it is no longer necessary to further move the bathtub 12, so that the process is terminated, maintaining the motor 24 halted (Step S59).

If, in Step S52, the setting key 302 is not found pressed, it is determined whether the storage key 303 is pressed, based on the level of the input signal from the input port Pi2 (Step S57). If the storage key 303 is not found pressed, the process is immediately terminated. If the storage key 303 is found pressed, it is determined whether the bathtub 58 has reached the storage position at the moment (Step S58). If the bathtub 58 has not reached the storage position, the bathtub tilting motor 24 is rotated in the reverse direction to lift up the supportive shaft 14 so that the bathtub 12 comes closer to the upright position (Step S60). If, in Step S58, it is determined that the bathtub 12 has already reached the storage position, it is no longer necessary to further move the bathtub 12, so that the process is terminated, maintaining the motor 24 halted (Step S59).

By repeating the above control process, it is possible to rotate the motor 24 in the normal or opposite direction so that the bathtub 12 changes its orientation only when either the setting key 302 or the storage key 303 is pressed. Releasing the key 302 or 303 will stop the motion of the bathtub 12.

[Changing Bathtub Angle]

Figure 29:
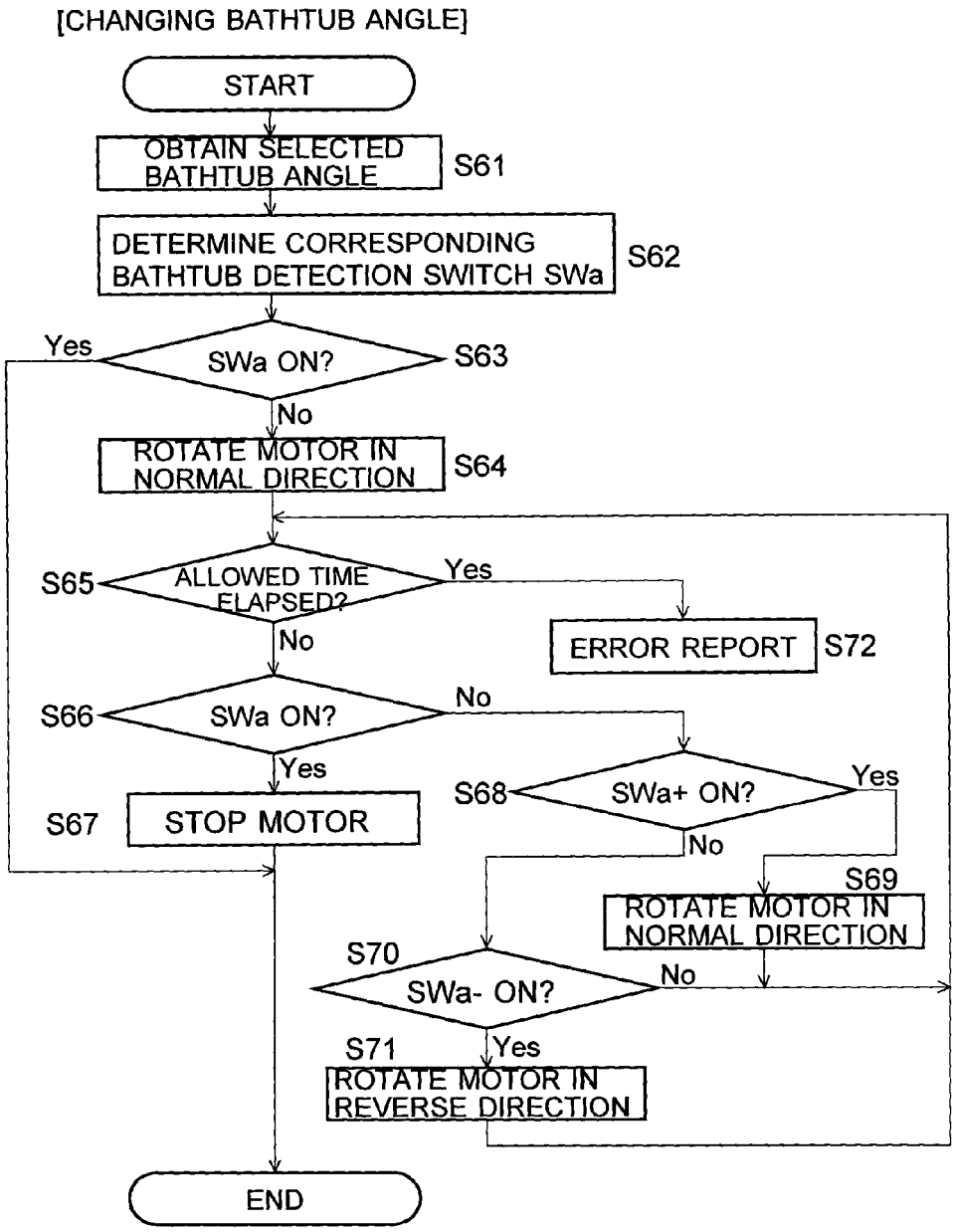
FIG. 29 is a flowchart showing the control process of changing the angle of the bathtub from the "sitz bath" position to the "full bath" position after the sitz bath process is completed.

FIG. 29 is a flowchart showing the control process of changing the angle of the bathtub 12 from the "sitz bath" position to the "full bath" position after the sitz bath process of Steps S14–S23 is completed.

The microcomputer 80 obtains information about which of the four bathtub angles is selected with the bathtub angle setting key 310 (Step S61), and determines the bathtub position detection switch SWa that corresponds to the selected angle at which the bathtub 12 should be stopped (Step S62). That is, in the present embodiment, one of the four bathtub position detection switches 26 separately arranged on the vertical pillar 10, as shown in FIGS. 6 and 20. Then, it is determined whether the selected switch SWa is ON or OFF (Step S63). If the switch SWa is ON, it means that the movable unit 21 is at the desired position and the bathtub 12 is at the selected orientation, so that the process is immediately terminated.

If, in Step S63, the switch SWa is found OFF, the bathtub tilting motor 24 is driven to rotate in the normal direction (Step S64) to further tilt the bathtub 12. Meanwhile, it is determined whether a preset allowed time has elapsed since the start of the driving of the motor 24 (Step S65). If the allowed time has not elapsed, it is determined whether the switch SWa has turned ON (Step S66). If the switch SWa is ON, it means that the bathtub 12 has reached the desired angle, so that the motor 24 is stopped (Step S67) and the process is terminated.

If, in Step S66, the switch SWa is found OFF, it is determined whether any switch (referred to as the "switch SW+" in FIG. 29) located higher than the selected switch SWa is ON (Step S68). If switch SW+is ON, it means that the bathtub 12 is not adequately tilted. Therefore, the motor 24 is driven to rotate in the normal direction (Step S69). After that, the process returns to Step S65. It should be noted that the determination result in Step S68 is always "No" if the switch SWa is the highest of the four switches.

If, in Step S68, the switch SW+ is found OFF, then it is determined whether any switch (referred to as the "switch SW−" in FIG. 29) located lower than the selected switch SWa is ON (Step S70). If switch SW− is ON, it means that the bathtub 12 is tilted too much. Therefore, the motor 24 is driven to rotate in the reverse direction (Step S71). After that, the process returns to Step S65.

If, in Step S65, it is determined that the allowed time has elapsed, it means that the bathtub 12 could not be brought to the desired angle within the allowed time. This fact implies that some problem has occurred, such as the malfunctioning of the motor 24 or the existence of an obstacle impeding the tilting motion of the bathtub 12. Therefore, the motor 24 is stopped, and the error is reported with the buzzer 30*c* or other device (Step S72).

By the above control process, the bathtub 12 can be correctly brought to a desired angle for a full bath. If the angle of the bathtub 12 cannot be correctly controlled, the information is reported to the caregiver. The apparatus in this embodiment is designed so that the angle of the bathtub 12 should be selected from four angles. Though this design is practically reasonable, it is possible to provide more precise angular settings. As regards the bathtub position detection switch, optical switches may be used in place of the magnetic reed switches, or other types of systems for detecting the position of an object may be used.

[Setting Temperature of Hot Water]

Figure 30:
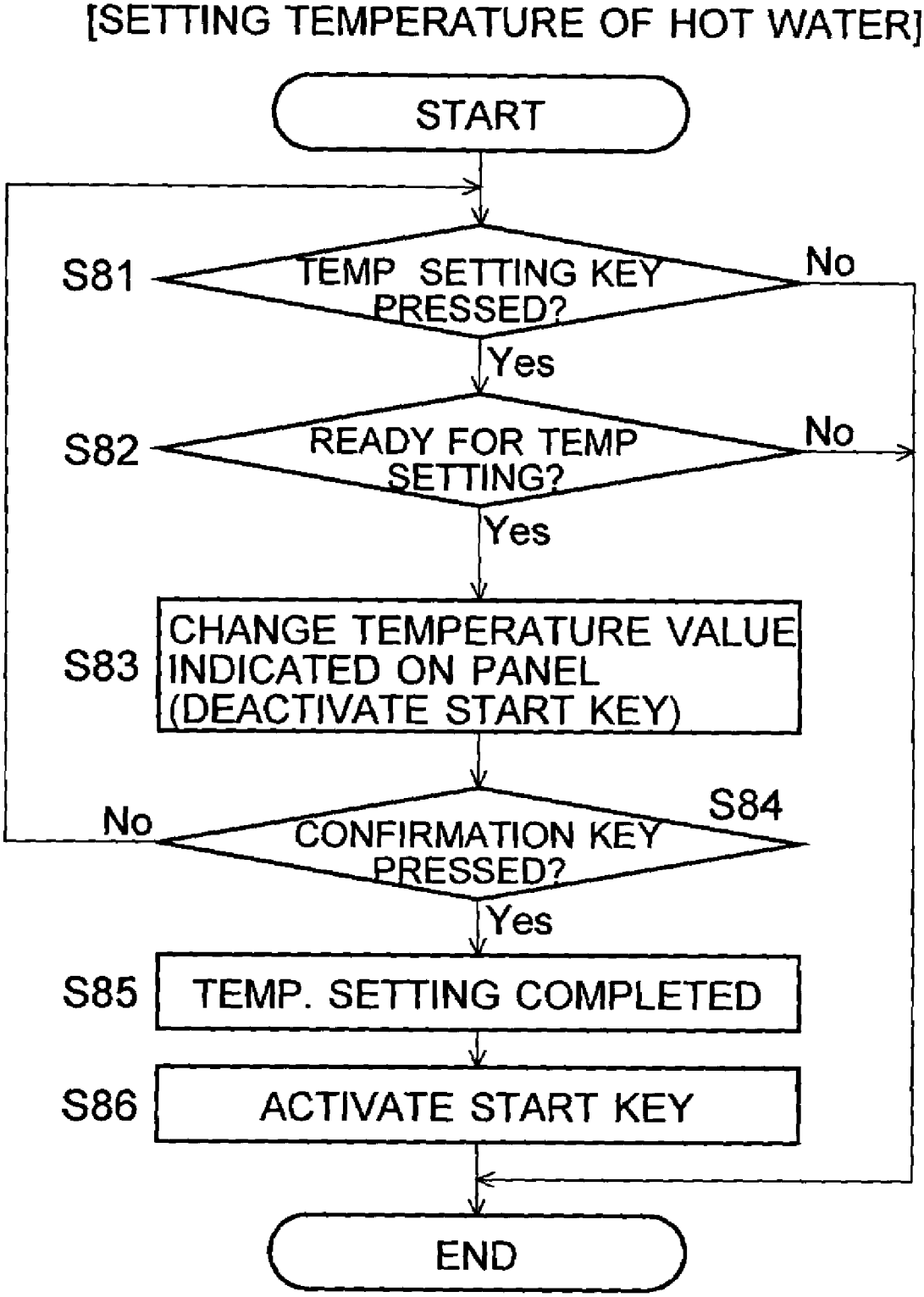
FIG. 30 is a flowchart showing the control process of setting the temperature of hot water in the tank by key operations.

FIG. 30 is a flowchart showing the control process of setting the temperature of hot water in the tank by key operations in Step S3.

When the caregiver operates the tank water temperature setting key 306 ("Yes" in Step S81), the microcomputer 80 determines whether the apparatus is ready for the temperature-setting operation (Step S82). If it is not ready, it means that it is not allowed to change the temperature setting at the moment, so that the process is immediately terminated without accepting the key operation. If ready, the temperature value indicated on the panel is changed according to the operation on the key 306 (Step S83). At this moment, the start key 308 is deactivated.

After accepting the key operation on the tank water temperature setting key 306 and detecting a key-pressing operation on the temperature confirmation key 307 performed by the caregiver ("Yes" in Step S84), the microcomputer 80 stops accepting the temperature setting, registers the temperature setting at the moment (Step S85), and activates the start key 308 (Step S86). Without pressing the temperature confirmation key 307, the caregiver cannot operate the start key 308. Therefore, the caregiver is always requested to confirm the temperature. This method prevents the hot-water supply from starting with an incorrect temperature setting or with an unintended high or low temperature setting, whereby the safety of the bather is ensured to a high degree.

[Regulating Amount and Temperature of Hot Water in Tank]

Figure 31:
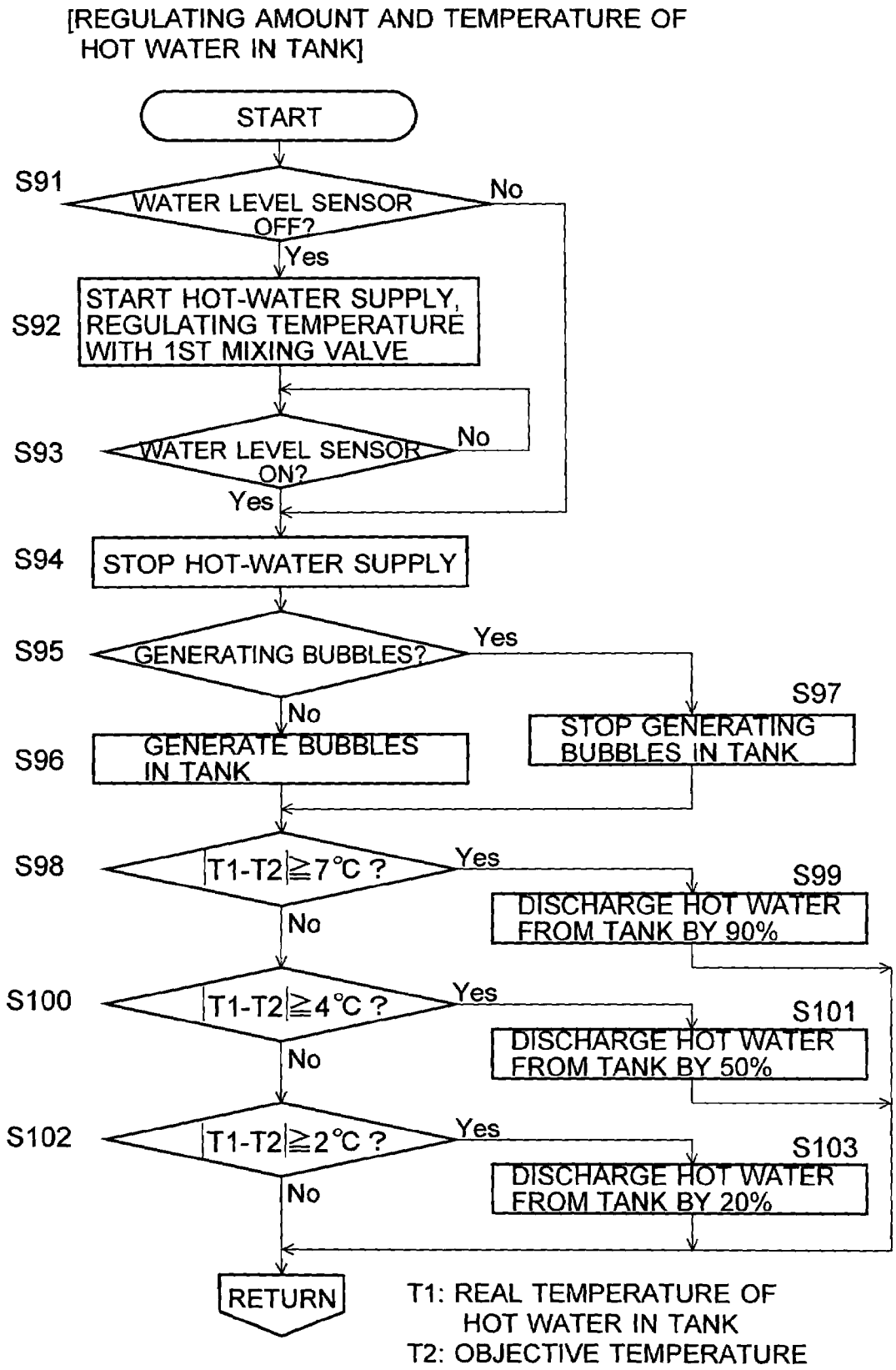
FIG. 31 is a flowchart showing the control steps of regulating the temperature of the hot water initially or additionally supplied into the tank.

FIG. 31 is a flowchart showing the control steps of regulating the temperature of the hot water initially supplied into the tank 11 through Steps S4–S6, or additionally supplied into the tank 11 when the water level in the tank 11 has lowered due to the hot-water supply into the bathtub 12.

When the process is started, the microcomputer 80 determines whether the switch used as the tank water level sensor 67 is OFF (Step S91). If the switch is OFF, it means that the tank 11 is not full. Therefore, the microcomputer 80 opens the tank water supply valve 45 to start supplying hot water into the tank 11, while regulating the temperature of the hot water with the first mixing valve 42 (Step S92). More specifically, the hot water supplied through the hot-water supply pipe 40 and the normal water supplied through the water supply pipe 41 are mixed with the first mixing valve 42 at appropriate mixing ratios to produce hot water having an appropriate temperature, which is supplied through the tank water supply valve 45 into the tank 11. After that, when the switch has turned ON ("Yes" in Step S93), the tank water supply valve 45 is closed to stop supplying the hot water (Step S94).

Next, it is determined whether the air pump 60 is generating bubbles (Step S95). If not, the air pump 60 is energized to generate bubbles in the tank 11 (Step S96). The bubbles stir the hot water in the tank 11, whereby the temperature of the hot water in the tank 11 is made more uniform. If, in Step S95, the air pump 60 is generating bubbles, the air pump 60 is halted to stop the bubbling (Step S97).

Following that process, the temperature detection signal from the tank water temperature sensor 64 is read, and the temperature T1 indicated by the signal is compared to the temperature T2 preset by the caregiver. If the temperature difference ?T (=|T1−T2|) is seven degrees centigrade or greater ("Yes" in Step S98), the torque motor 53 is driven to open the tank water drainage valve 52 for a predetermined period of time so that the hot water is discharged from the tank 11 by about 90% of the capacity of the tank 11 (Step S99). If the temperature difference ?T is less than seven degrees and greater than four degrees centigrade ("Yes" in Step S100), the valve 52 is opened for a predetermined period of time so that the hot water is discharged by about 50% of the capacity of the tank 11 (Step S101). If the temperature difference ? T is less than four degrees and greater than two degrees centigrade ("Yes" in Step S102), the valve 52 is opened for a predetermined period of time so that the hot water is discharged by about 20% of the capacity of the tank 11 (Step S101). If the temperature difference ?T is less than two degrees centigrade, the hot water in the tank 11 is held as is.

When, as in Steps S99, S101 or S103, a part of the hot water is discharged from the tank 11, the water level in the tank 11 decreases. To make up for the decrease, hot water with its temperature regulated is additionally supplied through the hot-water supply valve 45 into the tank 11. When, for example, the temperature of the hot water in the tank 11 has decreased to a certain extent with the lapse of time from the last use of the hot water, a portion of the hot water is discharged, and fresh hot water having the preset temperature is additionally supplied into the tank 11. Thus, the tank 11 almost constantly retains the full amount of hot water with its temperature regulated within an appropriate range. Alternatively, the tank 11 may be provided with a heater for heating the water stored therein. This construction eliminates the necessity of discharging cooled water.

[Regulating Amount of Hot Water Supplied into Bathtub]

Figure 33B:
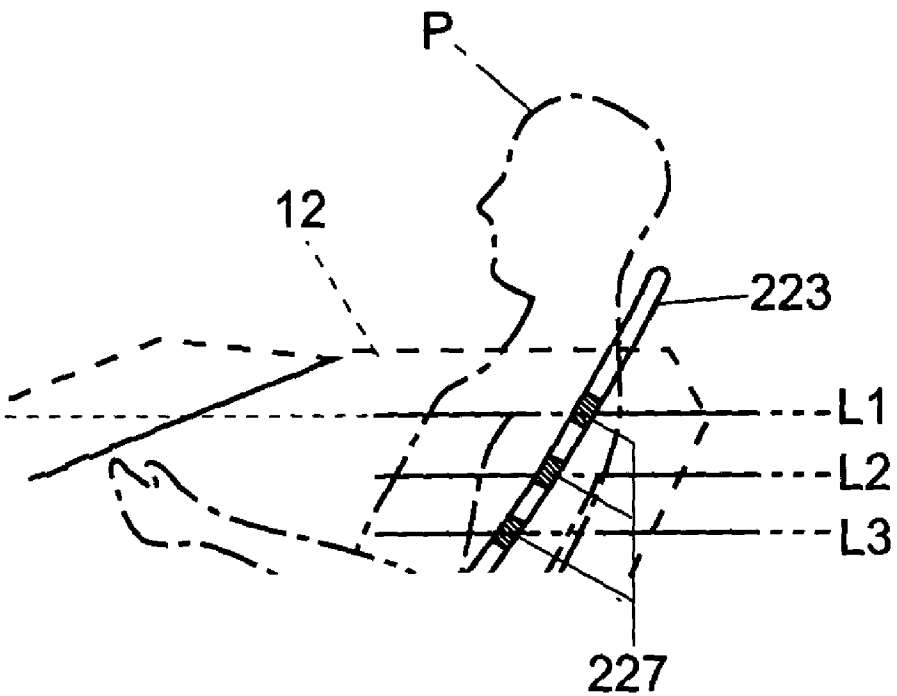
FIGS. 33A and 33B are side views for illustrating the operation of regulating the amount of hot water to be supplied into the bathtub.
Figure 33A:
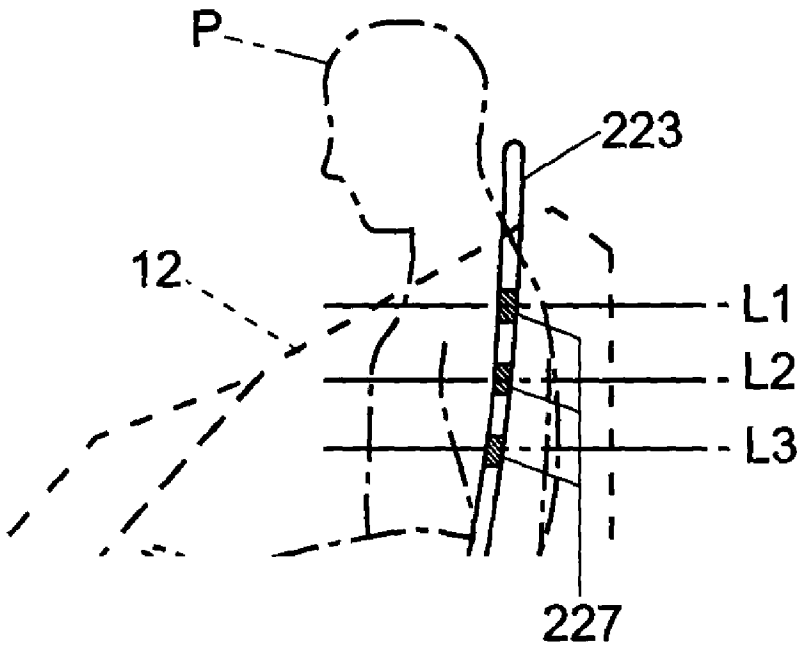

In the present embodiment, the caregiver selects one of the three water levels, using the water amount setting key 311, to specify the amount of hot water to supply into the bathtub 12. The three levels on the indicator of the water amount setting key 311 correspond to the three level marks 227 printed on the back frame 223 of the seat unit 220. However, even when the same level mark is selected, the actual height of the level mark changes depending on the angle of the bathtub 12 in the full-bathing position. Therefore, the reference water level that should be compared with the actual water level detected by the bathtub water level sensor 68 needs to be determined according to the bathtub angle, or it would be impossible to correctly supply hot water up to the level intended by the caregiver. FIGS. 33A and 33B show an example, where the bathtub angle is 50 degrees in the setting state (FIG. 33A), and 20 degrees in the normal bathing state (FIG. 33B). These figures show that the height of the level marks 227 significantly changes between the two states: the lowest mark L3 in FIG. 33A is at the same level as the highest mark L1 in FIG. 33B.

Figure 32:
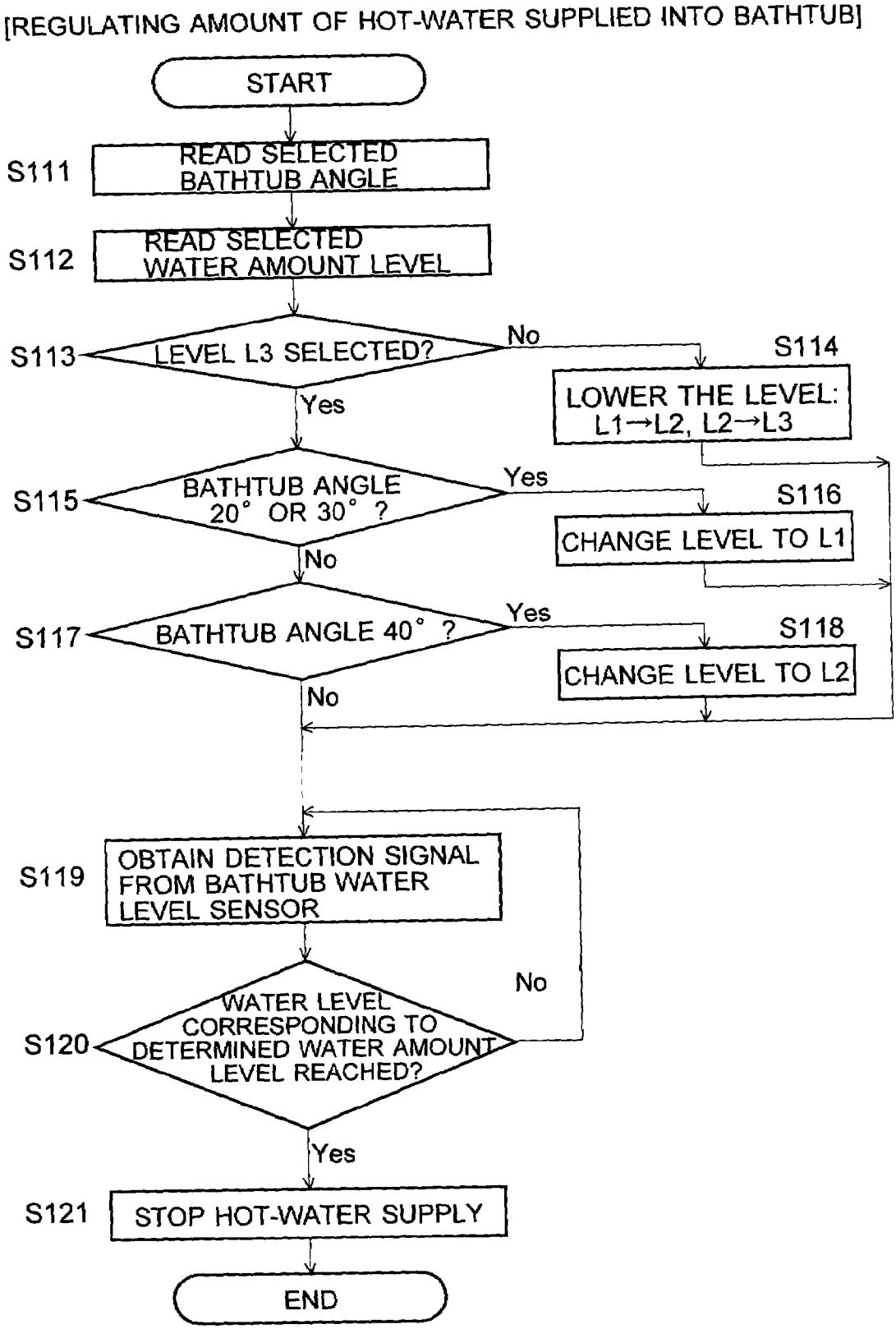
FIG. 32 is a flowchart showing the process of regulating the amount of supplying hot water, including steps of correcting the water level with respect to the bathtub angle.

FIG. 32 is a flowchart showing the process of regulating the amount of hot water to be supplied into the bathtub 12, including steps of correcting the water level with respect to the bathtub angle. The microcomputer 80 reads the bathtub angle selected beforehand by the caregiver from predetermined angles, i.e. 20, 30, 40 and 50 degrees in the present example (Step S111), and also reads the water amount level selected beforehand by the caregiver from L1, L2 and L3 corresponding to the three level marks 227 (Step S112). Next, it is determined whether the selected water amount level is L3, the lowest one (Step S113). If the water amount level is not L3 but L1 or L2, the water amount level is lowered by one grade. That is. L1 is lowered to L2, and L2 is lowered to L3 (Step S114).

If the selected water amount level is L3, it is determined whether the bathtub angle selected by the caregiver is 20 degrees, 30 degrees or else (Step S115). The angle 20 or 30 degrees corresponds to the normal bathing state or a state closer to that condition. Accordingly, if the selected angle is either 20 or 30 degrees, the water amount level is changed to L1 (Step S116). If the selected angle is neither 20 nor 30 degrees, it is determined whether the selected angle is 40 degrees (Step S117). The angle 40 degrees corresponds to a state close to the setting state (i.e. "sitz bath" state). In this state, the level marks 227 are located higher than in the case of the bathtub angle 20 or 30 degrees. Accordingly, the water amount level is changed to L2, one grade lower than in the case of 20 or 30 degrees (Step S118). If, in Step S117, the selected angle is not 40 degrees, then the selected angle is 50 degrees, which corresponds to the setting state with the level marks 227 at the relatively highest position. Therefore, the water amount level is maintained at L3, the lowest level.

After setting the water amount level according to the bathtub angle as described above, three water levels corresponding to the water amount levels L1, L2 and L3 are determined, irrespective of the tilting state of the bathtub 12. The hot-water supply will be stopped when the actual water level reaches the water level corresponding to the determined water amount level (Steps S119–S121). Even when the tilting angle of the bathtub 12 from the vertical axis is large, or when the bathtub angle is small, there is no possibility that the bathtub 12 is supplied with an abnormally small amount of water. Thus, an adequate amount of hot water is assuredly supplied for a full bath.

Finally, it should be noted that the above embodiment is an example of the present invention, and may be changed or modified within the spirit and scope of the present invention.

What is claimed is:

1. A bathing aid, comprising:

a wheelchair separable into a seat unit for a bather to sit down on and a bogie unit located under the seat unit;

a bathtub having an open top for receiving the seat unit with the bather sitting thereon;

a bathtub supporter for supporting the bathtub while allowing the bathtub to change its orientation so that the direction of the open top changes between an upward direction and a frontward direction;

an electrical driving power source; and a bathtub actuator for changing the orientation of the bathtub using a driving power of the driving power source, wherein the bathtub is held in an upright position where the open top is directed almost frontward to reduce a size of the area the bathtub occupies in the front-to-back direction when the bathtub is not used.

2. A bathing aid, comprising:

a wheelchair separable into a seat unit for a bather to sit down on and a bogie unit located under the seat unit;

a bathtub having an open top for receiving the seat unit with the bather sitting thereon;

a bathtub supporter for supporting the bathtub while allowing the bathtub to change its orientation so that the direction of the open top changes between an upward direction and a frontward direction; and a tank located in an upper part of the bathtub supporter for storing hot water to be supplied into the bathtub, wherein the bathtub is held in an upright position where the open top is directed almost frontward under the tank when the bathtub is not used.

3. The bathing aid according to claim 2, further comprising an operation panel located at a place behind the bathtub held in the upright position where the operation panel is partially hidden by the bathtub when the bathtub is not used and held in the upright position, wherein an operation key or operation keys that are operated when the bathtub is in the upright position are arranged in such a part of the operation panel that is not hidden by the bathtub.

4. A bathing aid, comprising:

a wheelchair separable into a seat unit for a bather to sit down on and a bogie unit located under the seat unit;

a bathtub having an open top for receiving the seat unit with the bather sitting thereon;

a bathtub supporter for supporting the bathtub while allowing the bathtub to change its orientation so that the direction of the open top changes between an upward direction and a frontward direction;

an electric driving power source;

a bathtub actuator for changing the orientation of the bathtub using a driving power of the driving power source, wherein the bathtub is held in an upright position where the open top is directed almost frontward when the bathtub is not used; and an operation panel located at a place behind the bathtub held in the upright position where the operation panel is partially hidden by the bathtub when the bathtub is not used and held in the upright position, wherein an operation key or operation keys that are operated when the bathtub is in the upright position are arranged in such a part of the operation panel that is not hidden by the bathtub.

5. A bathing aid, comprising:

a wheelchair separable into a seat unit for a bather to sit down on and a bogie unit located under the seat unit;

a bathtub having an open top for receiving the seat unit with the bather sitting thereon;

a bathtub supporter for supporting the bathtub while allowing the bathtub to change its orientation so that the direction of the open top changes between an upward direction and a frontward direction;

an electrical driving power source;

a bathtub actuator for changing the orientation of the bathtub using a driving power of the driving power source, wherein the bathtub is held in an oblique position where the open top is directed obliquely frontward when the bather is transferred into or out of the bathtub, and the position of the bathtub is changed to a predetermined orientation after the bather is transferred into the bathtub for bathing; and a stopper for mechanically stopping a tilting motion of the bathtub by bumping against a part of the bathtub or against a member that moves with the tilting motion of the bathtub.

6. A bathing aid, comprising:

a wheelchair separable into a seat unit for a bather to sit down on and a bogie unit located under the seat unit;

a bathtub having an open top for receiving the seat unit with the bather sitting thereon;

a bathtub supporter for supporting the bathtub while allowing the bathtub to change its orientation so that the direction of the open top changes between an upward direction and a frontward direction;

an electrical driving power source;

a bathtub actuator for changing the orientation of the bathtub using a driving power of the driving power source;

a water supplier for supplying hot water into the bathtub;

a drainage mechanism for draining the hot water from the bathtub;

an operation unit for allowing an operator to enter a command for starting an operation; and an operation controller, responsive to the command for starting the operation through the operation unit after the bather is set into the bathtub with the open top directed obliquely upward, by controlling the driving power source, the bathtub actuator, the water supplier and the drainage mechanism, for changing the orientation of the bathtub to a predetermined orientation, for supplying water into the bathtub with the water supplier, for retaining the water stored in the bathtub to provide the bather with a bathing condition for a predetermined period of time, for draining the water from the bathtub after the lapse of the predetermined period of time, and for moving the bathtub back to the same orientation where the bather is transferred into the bathtub, in order to allow the bather to be transferred out of the bathtub.

7. A bathing aid, comprising:

a wheelchair separable into a seat unit for a bather to sit down on and a bogie unit located under the seat unit;

a bathtub having an open top for receiving the seat unit with the bather sitting thereon;

a tank for storing hot water to be supplied into the bathtub;

temperature-setting means for setting an objective temperature;

a temperature detector for detecting a temperature of the water stored in the tank;

a temperature regulator for detecting the temperature of the water stored in the tank with the temperature detector, and for regulating the temperature of the water within a vicinity of the objective temperature when the objective temperature is set by the temperature-setting means; and a drainage mechanism for draining the hot water from the tank and a temperature pre-regulator for regulating the temperature of the hot water to be introduced into the tank at a temperature higher than the objective temperature, wherein the temperature regulator uses the drainage mechanism to drain the hot water by an amount determined according to the difference between the temperature detected by the temperature detector and the objective temperature, and supplies the tank with additional hot water whose temperature is regulated by the temperature pre-regulator to make up for the decrease of the hot water in the tank.

8. A bathing aid including:

a wheelchair separable into a seat unit for a bather to sit down on and a bogie unit located under the seat unit, and a main unit including a bathtub having an open top for receiving the seat unit with the bather sitting thereon, whereby the seat unit of the wheelchair with the bather sitting thereon is transferred into the bathtub, and then hot water is supplied into the bathtub, wherein the seat unit of the wheelchair has plural water level marks on a back thereof; and the main unit includes:

an input device for setting a value corresponding to an amount of hot water, using the level marks as a reference; and a water supplier for supplying hot water into the bathtub based on the value set through the input device.

9. A bathing aid, comprising:

a wheelchair separable into a seat unit for a bather to sit down on and a bogie unit located under the seat unit;

a bathtub having an open top for receiving the seat unit with the bather sitting thereon;

a bathtub supporter for supporting the bathtub while allowing the bathtub to change its orientation so that the direction of the open top changes between an upward direction and a frontward direction;

an electrical driving power source;

a bathtub actuator for changing the orientation of the bathtub using a driving power of the driving power source;

a water supplier for supplying hot water into the bathtub;

an angle-setting means for supplying the orientation of the bathtub for a bathing time;

a water-amount-setting means for determining an amount of hot water to be stored in the bathtub for bathing, with respect to the location on the body of the bather; and a water supply controller for determining a water level based on the amount of hot water specified by the water-amount-setting means and the orientation of the bathtub specified by the angle-setting means, and controlling the water supplier to supply hot water to the determined water level.

* * * * *